US010520873B2

(12) United States Patent
Ozaki et al.

(10) Patent No.: US 10,520,873 B2
(45) Date of Patent: Dec. 31, 2019

(54) IMAGE FORMING APPARATUS AND IMAGE FORMING METHOD

(71) Applicants: Yuuya Ozaki, Kanagawa (JP); Kazutaka Takeda, Osaka (JP); Kohji Yoshimura, Kanagawa (JP); Mizuna Tanaka, Tokyo (JP); Takashi Oida, Kanagawa (JP)

(72) Inventors: Yuuya Ozaki, Kanagawa (JP); Kazutaka Takeda, Osaka (JP); Kohji Yoshimura, Kanagawa (JP); Mizuna Tanaka, Tokyo (JP); Takashi Oida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 233 days.

(21) Appl. No.: 15/623,280

(22) Filed: Jun. 14, 2017

(65) Prior Publication Data

US 2017/0364014 A1 Dec. 21, 2017

(30) Foreign Application Priority Data

Jun. 17, 2016 (JP) ..... 2016-121080
Jan. 6, 2017 (JP) ..... 2017-001378
Apr. 10, 2017 (JP) ..... 2017-077690

(51) Int. Cl.
*G03G 15/00* (2006.01)

(52) U.S. Cl.
CPC ..... *G03G 15/5062* (2013.01); *G03G 15/6508* (2013.01); *G03G 15/6511* (2013.01); *G03G 15/6564* (2013.01)

(58) Field of Classification Search
None
See application file for complete search history.

(56) References Cited

U.S. PATENT DOCUMENTS 5,197,726 A * 3/1993 Nogami ..... B65H 7/02 271/110
2006/0268093 A1 11/2006 Kobayashi
(Continued)

FOREIGN PATENT DOCUMENTS

JP 2004-013039 1/2004
JP 2011-007949 1/2011
(Continued)

OTHER PUBLICATIONS

European Search Report; EP17175480; dated Nov. 10, 2017.

*Primary Examiner* — Jill E Culler
(74) *Attorney, Agent, or Firm* — Duft & Bornsen, PC

(57) ABSTRACT

An image forming apparatus includes an image bearer, an image forming device to form an image on the image bearer, a transfer device to transfer the image formed on the image bearer onto a sheet, a storage to store the sheet, a sheet feeder to convey the sheet one by one to the transfer device, and a slip amount prediction controller. The slip amount prediction controller calculates a predicted slip amount between the sheet feeder and the sheet before forming the image and, subsequently calculates an interval between images based on the predicted slip amount. The slip amount prediction controller controls the image forming device based on the calculated interval between images to form the image on the image bearer.

15 Claims, 32 Drawing Sheets

(56) References Cited

U.S. PATENT DOCUMENTS

| | | | | |
|---|---|---|---|---|
| 2007/0047978 | A1* | 3/2007 | Shibaki | G03G 15/6564 399/16 |
| 2010/0061745 | A1* | 3/2010 | Ito | G03G 15/101 399/43 |
| 2010/0239343 | A1 | 9/2010 | Nukumi | |
| 2015/0186761 | A1* | 7/2015 | Fujii | G03G 15/5029 358/1.12 |
| 2015/0301491 | A1 | 10/2015 | Yoshikawa et al. | |
| 2015/0346651 | A1 | 12/2015 | Nagata et al. | |

FOREIGN PATENT DOCUMENTS

| | | |
|---|---|---|
| JP | 2013-225012 | 10/2013 |
| JP | 2015-225172 | 12/2015 |

* cited by examiner

IMAGE FORMING APPARATUS AND IMAGE FORMING METHOD

CROSS-REFERENCE TO RELATED APPLICATIONS

This patent application is based on and claims priority pursuant to 35 U.S.C. § 119 to Japanese Patent Application Nos. 2016-121080, filed on Jun. 17, 2016, 2017-001378, filed on Jan. 6, 2017, and 2017-077690, filed on Apr. 10, 2017, in the Japanese Patent Office, the entire disclosures of which are hereby incorporated by reference herein.

BACKGROUND

Technical Field

Illustrative embodiments generally relate to an image forming apparatus and an image forming method.

Background Art

At present, printers and facsimile machines to output electronic data and image processing apparatuses, such as scanners, to convert information into electronic data are widely used. Such an image processing apparatus includes, for example, imaging, image forming, and communication functions, and therefore, can be used as a multifunction peripheral useable as a printer, a facsimile machine, a scanner, and a copier.

Among these image processing apparatuses, an image forming apparatus used for outputting computerized documents typically employs electrophotography. The image forming apparatus employing electrophotography forms an electrostatic latent image on a photoconductor by light exposure to the photoconductor, forms a toner image by developing the electrostatic latent image with a developer such as toner, transfers the toner image to a sheet, and outputs a printed sheet.

In the image forming apparatus employing electrophotography, sheets of recording media loaded in a sheet feeding tray are fed one by one by a feed roller and a toner image is transferred onto the sheet at a toner image forming timing (i.e., a timing of transferring a toner image onto a transfer belt in an image forming apparatus type that transfers the toner image formed on the photoconductor onto the transfer belt). A method for synchronizing toner image forming and sheet feeding uses a structure including a registration roller pair located before a transfer position in a sheet feeding direction. The registration roller pair stops the sheet temporarily, and restarts to send the sheet to the transfer position at the toner image forming timing.

A plurality of feeding rollers including the feed roller and the registration roller pair is used for feeding the sheet from a sheet tray to the transfer position. When any one of the feeding rollers wears down with use, the sheet slips over the feeding roller, delays sheet feeding, and misses the toner image forming timing. Thus, sheet jam tends to occur, requiring cleaning residual toner from the transfer belt and wasting both the sheet and expensive toner, and decreasing productivity of the image forming apparatus because a user needs to remove the sheet from the image forming apparatus.

SUMMARY

This specification describes an improved image forming apparatus. In one illustrative embodiment, the image forming apparatus includes an image bearer, an image forming device to form an image on the image bearer, a transfer device to transfer the image formed on the image bearer onto a sheet, a storage to store the sheet, a sheet feeder to convey the sheet one by one from the storage to the transfer device, and a slip amount prediction controller. The slip amount prediction controller calculates a predicted slip amount between the sheet feeder and the sheet before forming the image, and subsequently calculates an interval between the images based on the predicted slip amount. The slip amount prediction controller controls the image-forming device based on the calculated interval between the images to form the image on the image bearer.

This specification further describes an improved image forming method. In one illustrative embodiment, the image forming method includes calculating a predicted slip amount between the sheet feeder and the sheet, calculating an interval between images based on the calculated predicted slip amount, and controlling the image forming device based on the calculated interval between the images to form the image on the image bearer.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

DETAILED DESCRIPTION

Figure 1:
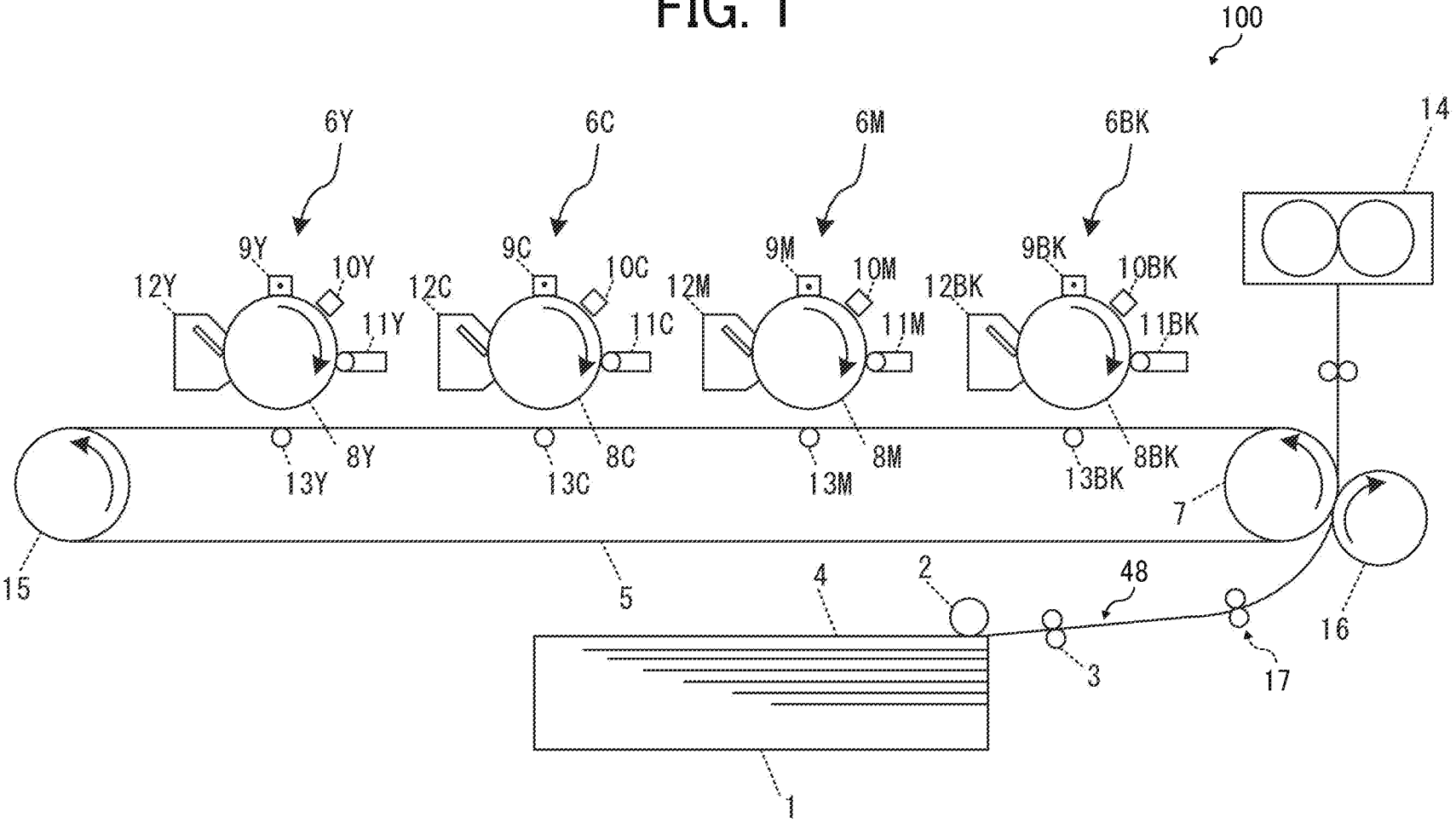
FIG. 1 is a schematic view illustrating a configuration of an image forming section in an image forming apparatus according to embodiments of the present disclosure.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 100 according to an embodiment is explained.

First Embodiment

Hereinafter, a description is given of an embodiment of an image forming method and the image forming apparatus 100. The image forming method and the image forming apparatus 100 according to the present embodiment calculate a predicted slip amount of a sheet serving as a recording medium before forming an image on an intermediate transfer belt 5 serving as an image bearer. The image forming method and the image forming apparatus 100 according to the present embodiment suitably control an interval between images on the intermediate transfer belt 5 based on the calculated predicted slip amount of the sheet. As a result, a timing of forming the image on the intermediate transfer belt 5 meets a timing of feeding the sheet.

Image Forming Section of the Image Forming Apparatus 100

FIG. 1 is a schematic view of an image forming section of the image forming apparatus 100 according to the present embodiment of the present disclosure. As illustrated in FIG. 1, the image forming section according to the present embodiment includes a plurality of image forming devices 6BK, 6M, 6C, and 6Y disposed in parallel along the intermediate transfer belt 5 serving as an image bearer. This configuration is called a tandem type.

In FIG. 1, the image forming devices 6BK, 6M, 6C, and 6Y line up in this order along the intermediate transfer belt 5 from upstream of the intermediate transfer belt moving direction. The image-forming device 6BK forms a black toner image, the image forming device 6M forms a magenta toner image, the image forming device 6C forms a cyan toner image, and the image forming device 6Y forms a yellow toner image.

These image forming devices 6BK, 6M, 6C, and 6Y have a similar configuration except the color of toner images formed thereby. Therefore, structure elements of the image forming device 6BK are described in detail below as a representative. Descriptions of structure elements of the other image forming devices 6M, 6C, and 6Y are only given subscripts "M", "C", and "Y" instead of "BK". The detailed descriptions of the other structure elements are omitted.

The intermediate transfer belt 5 is wound and stretched taut around a drive roller 7 and a driven roller 15 that are rotatable and located separately by a predetermined distance. The intermediate transfer belt 5 is driven in a predetermined direction by rotation of the drive roller 7. The drive roller 7, a drive motor, and the driven roller 15 function as a driver that drives the intermediate transfer belt 5.

The image forming device 6BK includes a photoconductor drum 8BK serving as an image bearer, and components disposed around the photoconductor drum 8BK, namely, a charging device 9BK, a light emitting diode (LED) head 10BK, a developing device 11BK, a photoconductor cleaner 12BK, and a discharger. The LED head 10BK irradiates the photoconductor drum 8BK with light to form an electrostatic latent image corresponding to a black toner image.

The electrostatic latent image is formed by exposure on a photoconductor surface of the photoconductor drum 8BK, that is, by emitting light corresponding to the black toner image from the LED head 10BK to the photoconductor surface of the photoconductor drum 8BK after the charging device 9BK uniformly charges the photoconductor surface of the photoconductor drum 8BK in the dark. The developing device 11BK visualizes the electrostatic latent image with black toner. Thus, a black toner image is formed on the photoconductive surface of the photoconductor drum 8BK.

The black toner image formed on the photoconductive surface of the photoconductor drum 8BK is transferred onto the intermediate transfer belt 5 at a position where the photoconductor drum 8BK contacts the intermediate transfer belt 5 by a transfer bias applied to a primary transfer roller 13BK. After the black toner image is transferred onto the intermediate transfer belt 5 and unnecessary toner left on the photoconductive surface is removed by photoconductor cleaner 12BK, subsequently, the discharger discharges the photoconductor drum 8BK in preparation to subsequent image formation.

The black toner image transferred to the intermediate transfer belt 5 is moved to a position where a magenta toner image is transferred and superimposed on the black toner image by rotation of the drive roller 7. The image forming device 6M forms the magenta toner image on a photoconductor drum 8M through processes similar to the processes performed by the image forming device 6BK. The magenta toner image is transferred from the photoconductor drum 8M onto the intermediate transfer belt 5 and superimposed on the black toner image on the intermediate transfer belt 5.

The magenta toner image transferred to the intermediate transfer belt 5 and superimposed on the black toner image on the intermediate transfer belt 5 is moved to a position where a cyan toner image is transferred and superimposed on the magenta toner image by rotation of the drive roller 7. The image forming device 6C forms the cyan toner image on a photoconductor drum 8C through processes similar to the processes performed by the image forming devices 6BK and 6M. The cyan toner image is transferred from the photoconductor drum 8C onto the intermediate transfer belt 5 and superimposed on the magenta toner image on the intermediate transfer belt 5.

The cyan toner image transferred to the intermediate transfer belt 5 and superimposed on the magenta toner image on the intermediate transfer belt 5 is moved to a position where a yellow toner image is transferred and superimposed on the cyan toner image by rotation of the drive roller 7. The image forming device 6Y forms the yellow toner image on a photoconductor drum 8Y through processes similar to the processes performed by the image forming devices 6BK, 6M, and 6C. The yellow toner image is transferred from the photoconductor drum 8Y onto the intermediate transfer belt 5 and superimposed on the cyan toner image on the intermediate transfer belt 5. After the toner image is transferred to the intermediate transfer belt 5, unnecessary toner left on the photoconductor surface is removed by each of photoconductor cleaners 12M, 12C, and 12Y. Subsequently, the discharger discharges each of the photoconductor drums 8M, 8C, and 8Y in preparation to subsequent image formation.

Thus, a full color toner image is formed on the intermediate transfer belt 5.

A sheet feeder is between a sheet tray 1 serving as a storage that stores a sheet 4 and a transfer portion that is configured with the intermediate transfer belt 5 and a secondary transfer roller 16. The sheet feeder conveys the sheet 4 serving as a recording medium from the sheet tray 1 to the transfer portion. The sheet feeder includes a feed roller 2, a separation roller 3, and a registration roller pair 17. A sheet detector 48 is disposed between the separation roller 3 and the registration roller pair 17. The sheet detector 48 configures a detecting part of the present embodiment.

The sheet 4 is fed one by one at a predetermined timing from the sheet tray 1 that stores the sheet 4 to the transfer portion. In the transfer portion, the toner image is transferred onto the sheet 4. For example, the sheet 4 is picked up and fed from the sheet tray 1 by the feed roller 2, separated one by one by the separation roller 3, conveyed to the transfer portion, and brought into contact with the registration roller pair 17. The registration roller pair 17 starts to rotate at a timing such that the sheet 4 meets the toner image transferred to the intermediate transfer belt 5. The sheet 4 that contacts the registration roller pair 17 is fed to the transfer portion.

In the transfer portion, the toner image transferred to the intermediate transfer belt 5 is transferred to the sheet 4 by a bias voltage applied to the secondary transfer roller 16.

The sheet 4 transferred with the toner image is transported to a fixing device 14, where the toner image is fixed on the sheet 4. Next, the sheet 4 is ejected outside the image forming apparatus 100.

Bias voltages are supplied from a high voltage power source to the charging devices 9BK, 9M, 9C, and 9Y, the developing devices 11BK, 11M, 11C, and 11Y, the primary transfer rollers 13BK, 13M, 13C, and 13Y, and the secondary transfer roller 16.

The image forming devices 6BK, 6M, 6C, and 6Y and the primary transfer rollers 13BK, 13M, 13C, and 13Y construct an image forming device.

Functional Block of the Image Forming Apparatus 100

Figure 2:
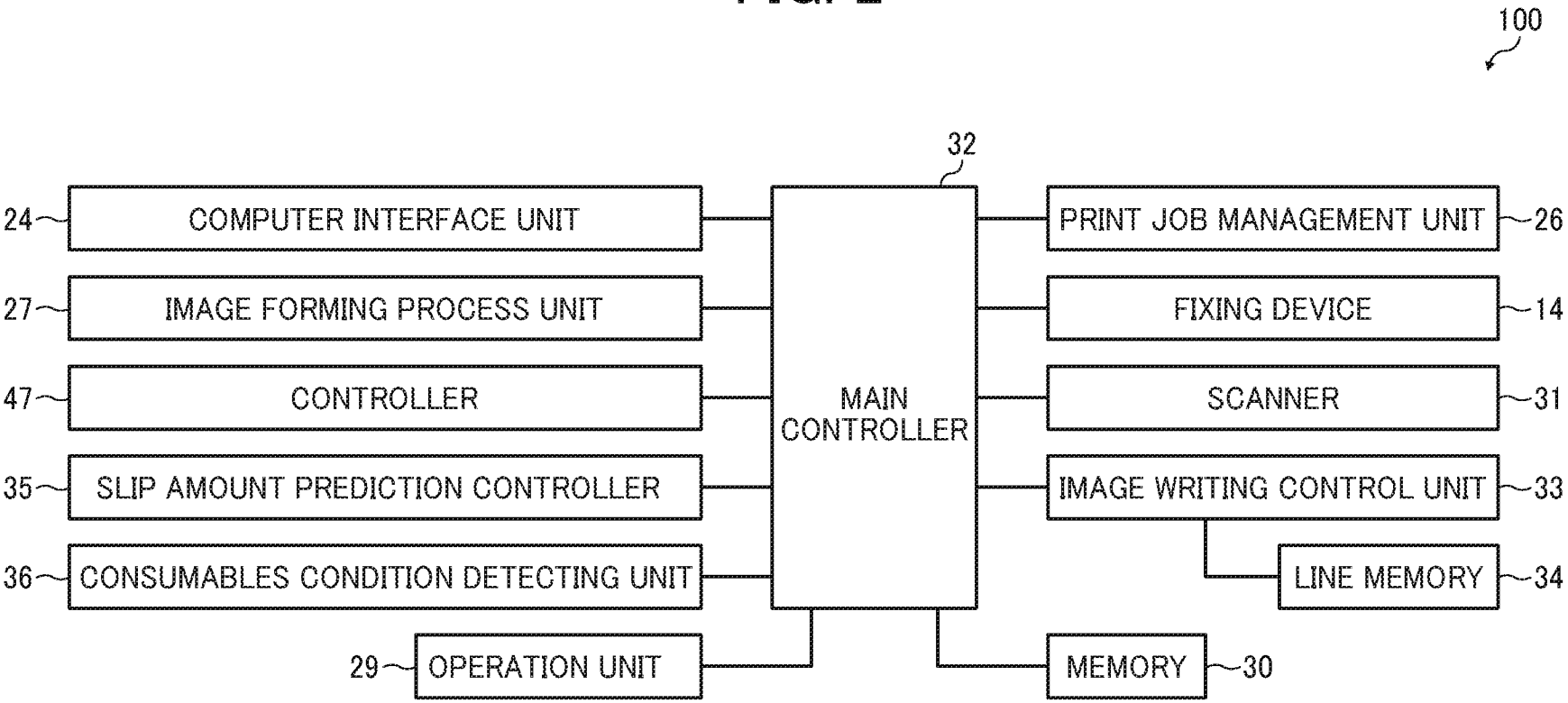
FIG. 2 is a functional block diagram of the image forming apparatus according to embodiments of the present disclosure.

FIG. 2 is a functional block diagram of the image forming apparatus 100 according to the present embodiment. As illustrated in FIG. 2, the image forming apparatus 100 according to the present embodiment is characterized by the presence of a slip amount prediction controller 35 in the functional block diagram. The slip amount prediction controller 35 predicts a slip amount of the sheet 4 and controls an interval between toner images based on the predicted slip amount.

Other functional blocks are general functional blocks of image forming apparatuses such as a conventional multifunction peripheral. A computer interface unit 24 communicates with a terminal device that sends a print request to the image forming apparatus 100. A controller CTL 47 receives image data from the terminal device, sends the image data to a main controller 32, and issues a print request to the image forming apparatus 100. A print job management unit 26 manages order of print jobs requested to the image forming apparatus 100.

An image forming process unit 27 controls the image forming section, which forms a toner image using electrophotography based on the image data from the terminal device and transfers the toner image to the sheet 4. The image forming process unit 27 also performs detection of displacement of the toner image and correction of the displacement. The fixing device 14 fixes the toner image, which is transferred by the image forming process unit 27, on the sheet 4 under heat and pressure.

An operation unit 29 displays the status of the image forming apparatus 100 and receives inputs to the image forming apparatus 100. A memory 30 stores necessary information for the image forming apparatus 100 at a suitable time. A scanner 31 converts document print data into electrical signals. The main controller 32 controls a series of operations of the above functional blocks.

An image writing control unit 33 converts the image data sent from the CTL 25 into control signals of the LED heads 10BK, 10M, 10C and 10Y and controls turning on the LED heads 10BK, 10M, 10C, and 10Y. A line memory 34 stores the data sent from the CTL 25 in a buffer temporarily and controls a skew amount by image processing.

A consumables condition detecting unit 36 detects condition (e.g., durability) of the photoconductor drums 8BK, 8M, 8C, and 8Y, the charging devices 9BK, 9M, 9C, and 9Y, the LED heads 10BK, 10M, 10C, and 10Y, the developing devices 11BK, 11M, 11C, and 11Y, the photoconductor cleaners 12BK, 12M, 12C, and 12Y, the dischargers, the primary transfer rollers 13BK, 13M, 13C, and 13Y, the secondary transfer roller 16, the feed roller 2, the separation roller 3, the drive roller 7, and the like. To detect the condition of the above consumables, the consumables condition detecting unit 36 measures cumulative travel distances of the primary transfer rollers 13BK, 13M, 13C, and 13Y, the secondary transfer roller 16, the feed roller 2, the separation roller 3, the registration roller pair 17, and the drive roller 7. The measured travel distances are stored in the memory 30.

Hardware Configuration of an Image Forming Apparatus 100

Figure 3:
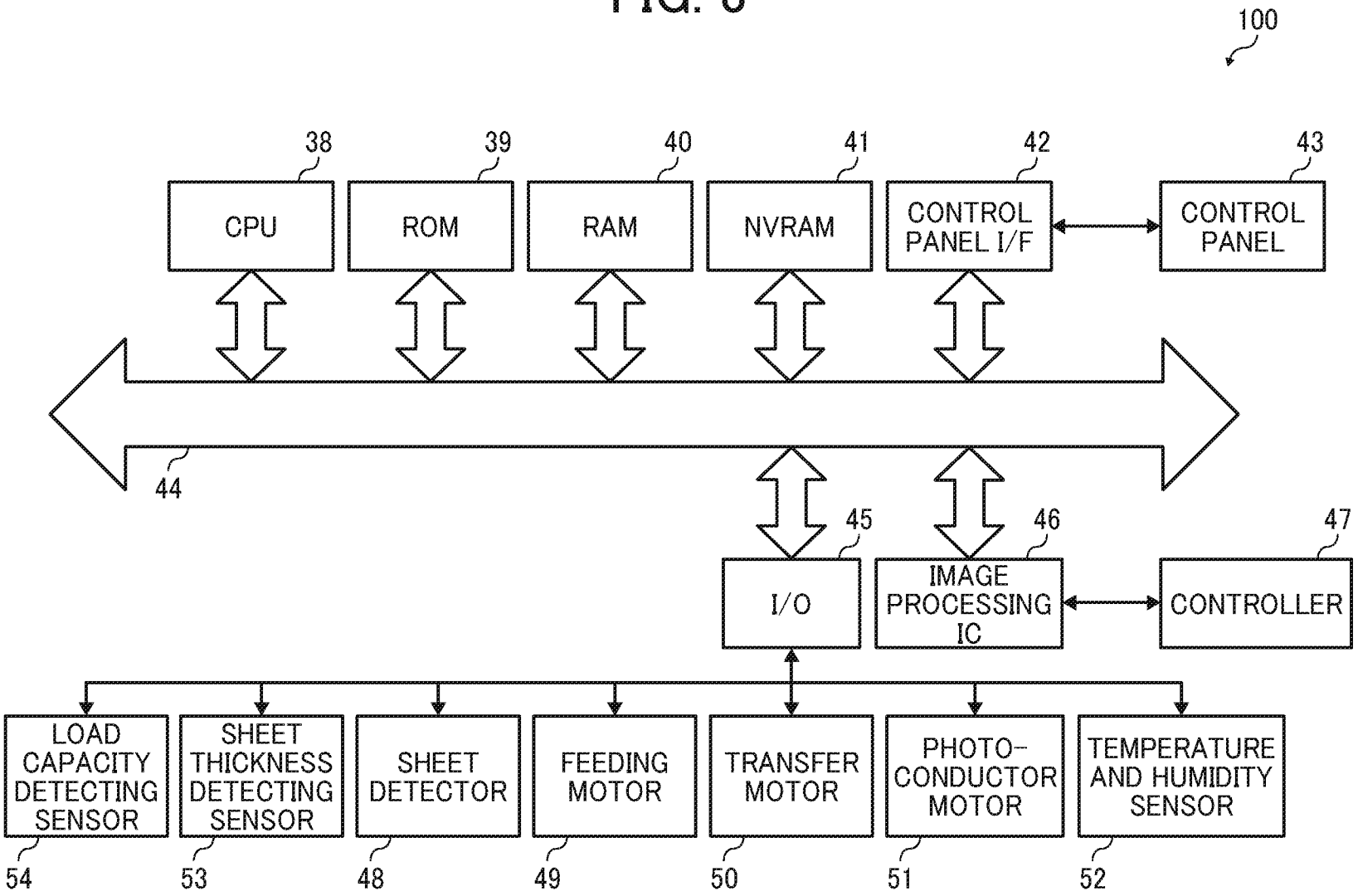
FIG. 3 is a schematic block diagram of a hardware configuration of the image forming apparatus according to embodiments of the present disclosure.

The hardware configuration of the image forming apparatus 100 illustrated in FIG. 3 illustrates an example of a hardware configuration of a printer.

As illustrated in FIG. 3, in the image forming apparatus 100 according to the present embodiment, a central processing unit (CPU) 38, a read only memory (ROM) 39, a random access memory (RAM) 40, a non-volatile random access memory (NVRAM) 41, a control panel interface (I/F) 42, an input-output (I/O) 45, and an image processing integrated circuit (IC) 46 are connected to each other via a system bus 44. The ROM 39, the RAM 40, and the NVRAM 41 construct the memory 30 of the image forming apparatus 100 according to the present embodiment.

The control panel I/F 42 is connected to a control panel 43 that is operated by users. The image processing integrated circuit 46 is connected to a controller 47. The I/O 45 is connected to the sheet detector 48 that detects a conveyed sheet 4, a feeding motor 49 that rotates feeding rollers for feeding the sheet 4 including the feed roller 2 and the separation roller 3, a transfer motor 50 that rotates the primary transfer rollers 13BK, 13M, 13C, and 13Y, a photoconductor motor 51 that rotates the photoconductor drums 8BK, 8M, 8C, and 8Y serving as photoconductors, a temperature and humidity sensor 52 that detects a temperature and a humidity of the sheet 4, a sheet thickness detecting sensor 53 that detects a thickness of the sheet 4, and a load capacity detecting sensor 54 that detects a load capacity of the sheets 4 in the sheet tray 1.

The control panel I/F 42 connects the control panel 43 to the CPU 38. The control panel 43 includes a display part and an input part, and functions as a user interface. The control panel 43 is used to set a printer mode and the like. The CPU 38 and the control panel 43 exchange data via the control panel I/F 42. Furthermore, the CPU 38 is connected to the controller 47 via the image processing integrated circuit 46. The CPU 38 obtains a printing condition such as a sheet thickness of the sheet 4 from the controller 47.

The CPU 38 of the image forming apparatus 100 controls access to various devices connected with the system bus 44 according to control programs and the like stored in the ROM 39. The CPU 38 also controls inputs and outputs of signals of the sheet detector 48, the feeding motor 49, the transfer motor 50, the photoconductor motor 51, and the temperature and humidity sensor 52, which are connected to each other via the I/O 45. The CPU 38 executes the control programs for the image forming apparatus 100 stored in the ROM 39.

According to orders made of a control program, control data, and the like, the CPU 38 predicts the slip amount about the sheet 4 and performs a control of the interval between toner images based on the predicted slip amount. That is, the CPU 38 works as the slip amount prediction controller 35. A detailed description of the concrete steps in the process of controlling the interval between the toner images is deferred.

The ROM 39 is a non-volatile memory dedicated to reading out and stores the control programs, the control data, and the like that are used by the CPU 38.

The RAM 40 is a volatile memory capable of high-speed data reading and writing. The RAM 40 is used as a work frame memory to store environmental data and expand recorded data.

The NVRAM 41 is a non-volatile storage memory capable of reading and writing information and stores information about the image forming apparatus 100 for use of the control programs.

Prediction of the Slip Amount and Control of the Interval Between Toner Images Based on the Predicted Slip Amount With reference to FIGS. 4 to 9, a description is provided of how the CPU 38 predicts the slip amount of the sheet 4 and controls the interval between toner images based on the predicted slip amount. In the following description, mark "S" means step of processing flow.

Figure 4:
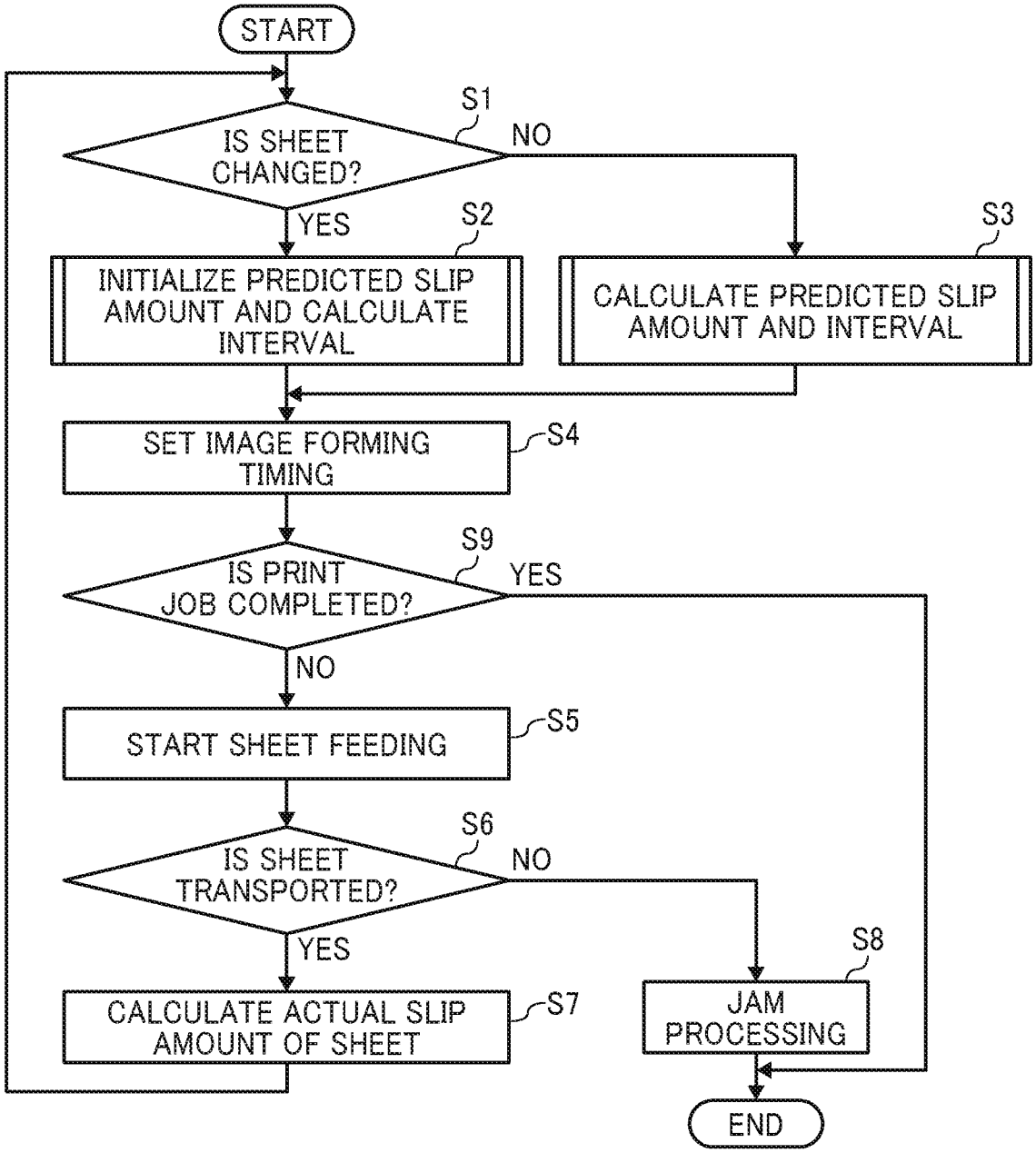
FIG. 4 is a flowchart illustrating a basic process flow of the image forming apparatus according to embodiments of the present disclosure.

FIG. 4 is a flowchart illustrating a basic process flow of the image forming apparatus 100 according to the present embodiment. As illustrated in FIG. 4, after a print start is requested from the control panel 43, the CPU 38 determines whether the sheet 4 is changed (step S1), the CPU 38 serving as a situation detector to detect a change in condition of the sheet. For example, the CPU 38 determines the change of the sheet 4 when the print start is requested after the sheet tray 1 is pulled out and set, a power switch of the image forming apparatus 100 is turned on, or the like.

When the sheet 4 is changed (YES in step S1), chances are high that the sheet 4 changes the paper type or the sheet set position. The change of the sheet 4 about the paper type or the sheet set position results in the change of the print condition used for the prediction of the slip amount of the sheet 4. The prediction of the slip amount based on the print condition before the change may result in low prediction accuracy. Therefore, when the sheet 4 is changed, the CPU 38 initializes the predicted slip amount and calculates the interval between the toner images based on the initialized predicted slip amount (step S2).

How to initialize the predicted slip amount is considered via three methods as follows. (1) The predicted slip amount is set as a limit value that does not decrease the print speed of the image forming apparatus 100. (2) Based on the print condition, the slip amount is predicted and set. (3) If a previous print job is finished due to a sheet jam, the predicted slip amount is set larger than the previous one.

Figure 5:
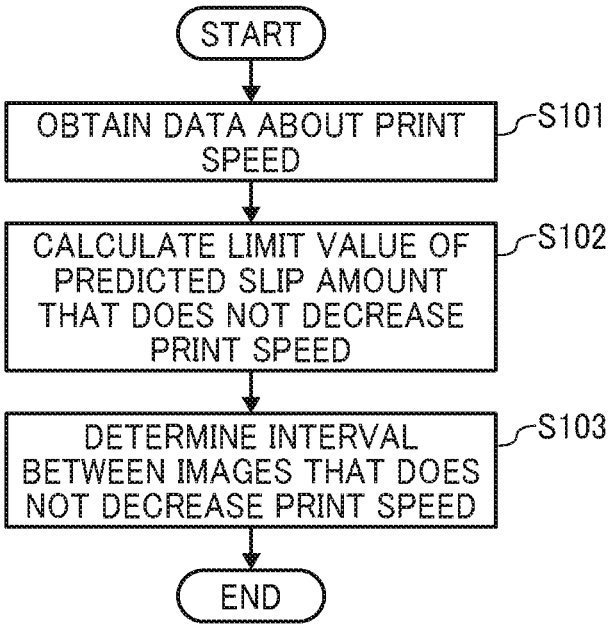
FIG. 5 is a flowchart illustrating a first example of an initialization process flow of the image forming apparatus according to embodiments of the present disclosure.
Figure 6:
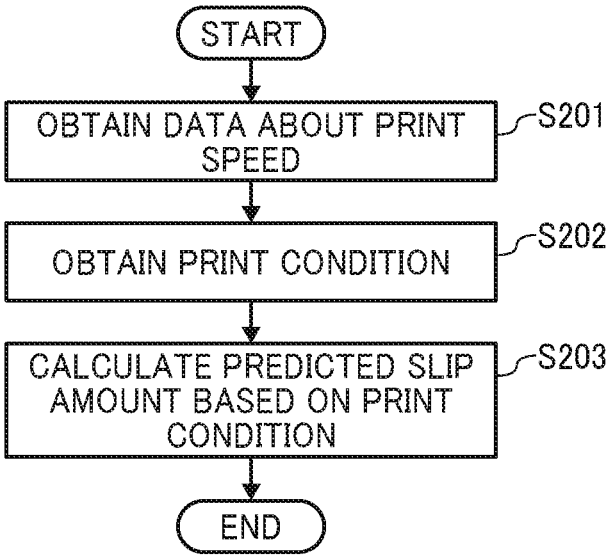
FIG. 6 is a flowchart illustrating a second example of the initialization process flow of the image forming apparatus according to embodiments of the present disclosure.
Figure 7:
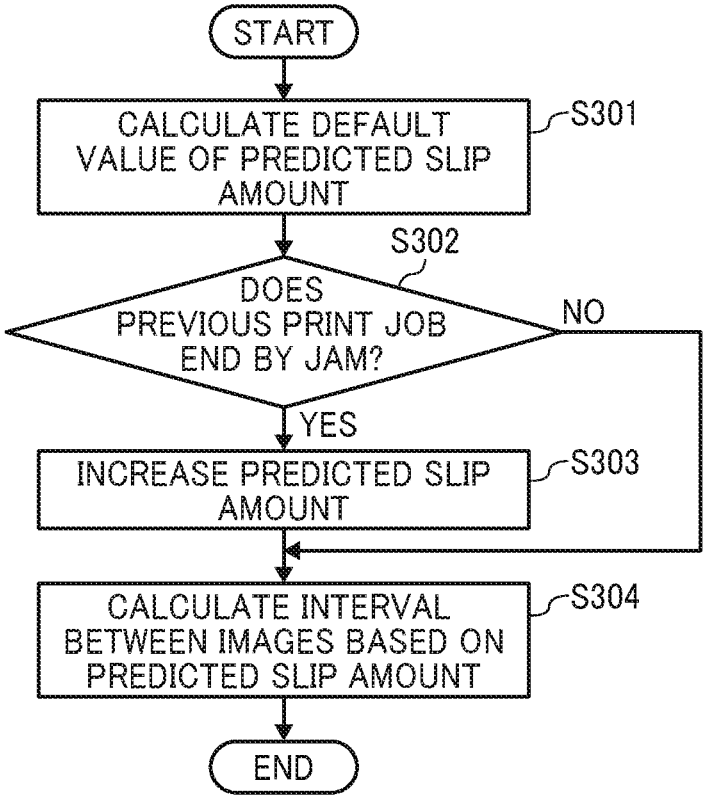
FIG. 7 is a flowchart illustrating a third example of the initialization process flow of the image forming apparatus according to embodiments of the present disclosure.

A detailed description regarding the above is provided referring to FIGS. 5 to 7.

After the initialization of the predicted slip amount and the calculation of the interval between the toner images, the CPU 38 sets an image forming timing (step S4), rotates feeding rollers for feeding the sheet 4 including the feed roller 2 and the separation roller 3, and starts the sheet feeding (step S5).

Setting the image forming timing in step S4 is carried out based on the interval between the toner images calculated in step S2. After finishing the initialization of the predicted slip amount in step S2, the image forming timing may be set automatically. After setting the image forming timing, the CPU 38 determines whether a print job is completed (step S9). If the print job is completed, the CPU 38 ends this process (YES in step S9). If the print job is not completed, the CPU 38 proceeds to step S5 (NO in step S9).

When the CPU 38 starts the sheet feeding in step S5, the start time of the sheet feeding is stored in the memory 30 of the image forming apparatus 100.

Next, the CPU 38 determines whether the sheet detector 48 detects a transportation of the sheet 4 within a predetermined time after the start time of the sheet feeding on the basis of an output signal from the sheet detector 48 and the start time of the sheet feeding stored in the memory 30 of the image forming apparatus 100 in step S5 (step S6). When the CPU 38 determines the sheet detector 48 detects the transportation of the sheet 4 within the predetermined time after the start time of the sheet feeding (YES in step S6), the CPU 38 calculates an actual slip amount of the sheet 4 in step S7 and returns to step S1.

When the CPU 38 determines the sheet detector 48 detects transportation of the sheet 4 within the predetermined time after the start time of the sheet feeding (YES in step S6), the CPU 38 obtains a time that the sheet detector 48 detects the transportation of the sheet 4 and calculates a difference between the start time of the sheet feeding and the time that the sheet detector 48 detects transportation of the sheet 4. A result of the calculation is stored in the memory 30 of the image forming apparatus 100 to use in step S7.

When the CPU 38 determines that the sheet 4 is not changed in step S1 (NO in step S1), the CPU 38 calculates the predicted slip amount in step S3. In addition, the CPU 38 calculates the interval between the toner images based on the predicted slip amount calculated in step S3. The calculation of the predicted slip amount uses the actual slip amount of the sheet 4 calculated in step S7 and means the prediction of the slip amount of next sheet feeding. After the calculation of the predicted slip amount, the CPU 38 sets image forming timing (step S4).

How to calculate the predicted slip amount is considered via two methods as follows. (1) The predicted slip amount is predicted based on the print condition and compared with the actual slip amount. If a difference between the actual slip amount and the predicted slip amount is greater than a predetermined value, the CPU 38 corrects the predicted slip amount. (2) The predicted slip amount is determined by using a plurality of actual slip amounts.

A detailed description regarding the above is provided later referring to FIGS. 8 to 9B.

When the sheet detector 48 does not detect the transportation of the sheet 4 within the predetermined time after the start time of the sheet feeding (NO in step S6), the CPU 38 determines that a sheet jam has occurred, proceeds to a jam processing in step S8, and ends this process because, when the sheet detector 48 does not detect the transportation of the sheet 4 within the predetermined time after the start time of the sheet feeding, there is a strong possibility of a sheet jam, and not just a simple slip of the sheet 4. In this case, even if the interval between the toner images is set larger, the transportation of the sheet 4 is too late for a secondary-transfer timing. Therefore, the CPU 38 proceeds to a jam processing. The predetermined time to determine that a sheet jam has occurred may be set to double a normal time from the start time of the sheet feeding to the time the sheet 4 is detected by the sheet detector 48.

First Example of the Initialization Method of the Predicted Slip Amount

With reference to FIG. 5, the first example of the initialization of the predicted slip amount is described below. In the first example of the initialization method of the predicted slip amount, the predicted slip amount is set as a limit value that does not decrease the print speed of the image forming apparatus 100.

When starting the initialization of the predicted slip amount, the CPU 38 obtains the data about the print speed of the image forming apparatus 100 from the controller 47 (step S101), the CPU 38 serving as a productivity information obtaining device. The control of the first embodiment may change the print speed in the step S3 in the flowchart of FIG. 4. Therefore, the CPU 38 obtains the data about the print speed with each initialization.

Next, the CPU 38 calculates the limit value of the predicted slip amount that does not decrease the print speed of the image forming apparatus 100 in step S102. In a certain structure of the image forming apparatus 100, the above initialization may be made after a first sheet feeding.

The CPU 38 determines the interval between the toner images based on the calculated limit value of the predicted slip amount that does not decrease the print speed of the image forming apparatus 100 (step S103) and ends the initialization of the predicted slip amount. After this initialization, the CPU 38 proceeds with the control of the first embodiment in FIG. 4 and may change the predicted slip amount in step S3 in FIG. 4.

The Second Example of the Initialization Method of the Predicted Slip Amount

With reference to FIG. 6, the second example of the initialization method of the predicted slip amount is described below. In the second example of the initialization method of the predicted slip amount, the slip amount is predicted based on the print condition and initialized by setting the predicted slip amount.

When starting the initialization of the predicted slip amount, the CPU 38 obtains the data about the print speed of the image forming apparatus 100 from the controller 47 (step S201). The CPU 38 obtains the data about the print speed of the image forming apparatus 100 in each initialization like in the first example.

Next, the CPU 38 obtains a linear velocity of the feeding rollers that feed the sheet 4, a paper type of the sheet 4, temperature and humidity inside the image forming apparatus 100, data about the sheet tray 1, a travel distance of the feed roller, the thickness of the sheet, a double feeding amount, a sheet feeding method, a load capacity of the sheets 4 in the sheet tray 1, and the like as the print conditions (step S202). The CPU 38 determines the linear velocity of the feeding roller based on a diameter and a number of revolutions of the feeding roller (related to a number of revolutions of the feeding motor 49). The CPU 38 may obtain the temperature and the humidity inside the image forming apparatus 100 from the temperature and humidity sensor 52. High humidity increases the moisture content of the sheet 4 and affects the transportation of the sheet 4. On the other hand, low temperature makes the sheet 4 stiff and hard to bend, which increases a force required to transport the sheet 4 and a slip amount. The CPU 38 may obtain the paper type of the fed sheet 4 from the controller 47.

The CPU 38 may obtain data about the sheet tray 1 of the print conditions from the controller 47 in step S202. The data about the sheet tray 1 includes at least one of a distance from the sheet tray 1 to a transporting sensor and data about a transportation path, which affect the slip of the sheet 4.

The CPU 38 may obtain the travel distance of the feed roller 2 based on a driving time of the motor that drives the feed roller 2. An increase of the travel distance of the feed roller 2 causes an increase of paper dust adhered to the feed roller 2. The paper dust affects abrasion of a surface of the feed roller 2 and results in an increase of the slip between the feed roller 2 and the sheet 4. That is, an increase of the travel distance of the feed roller 2 tends to cause an increase of slip The CPU 38 may obtain the thickness of the sheet 4 from the sheet thickness-detecting sensor 53. If the image forming apparatus 100 does not include the sheet thickness-detecting sensor 53, the CPU 38 may obtain the thickness of the sheet 4 from the print conditions sent form the controller 47. A thicker sheet 4 is stiffer and harder to bend. This increase a force to transport the sheet 4 and a slip amount.

The double feeding amount is a control parameter that means a feeding amount of a second sheet 4 after a first sheet 4 passes through the sheet tray 1 and determined based on the control content. A hardware configuration of the sheet feeding method is determined in advance in each sheet tray 1. Therefore, it is possible to identify the sheet feeding method based on the selected sheet tray 1.

The CPU 38 may obtain the load capacity of the sheets 4 in the sheet tray 1 from the load capacity-detecting sensor 54. The more sheets 4 in the sheet tray 1 cause the larger angle between the sheet 4 and a sheet path from the sheet tray 1. The large angle between the sheet 4 and the sheet path from the sheet tray 1 makes difficult to transport the sheet 4 from the sheet tray 1 compared with a situation in which there are less sheets 4 in the sheet tray 1. However, in the situation in which there are less sheets 4 in the sheet tray 1, a pressure to the feed roller 2 becomes lower, results in a weak transportation force, and becomes difficult to transport the sheet 4.

Next, in step S203, the CPU 38 calculates the predicted slip amount based on the print condition that is gotten in the step S202.

The CPU 38 calculates the interval between the toner images based on the predicted slip amount (step S204) and ends the initialization of the predicted slip amount. The interval between the toner images is calculated by the following procedure. The CPU 38 calculates a default value of the interval between the toner images based on the data about the print speed gotten in step S201. Next, based on the calculated default value of the interval between the toner images and the interval between the sheets 4 during sheet feeding, the CPU 38 calculates a maximum slip amount that does not change the interval between the toner images. If the predicted slip amount is larger than the maximum slip amount, the interval between the toner images is set larger. If the predicted slip amount is not larger than the maximum slip amount, the interval between the toner images is set the default value of the interval between the toner images.

Third Example of the Initialization Method of the Predicted Slip Amount

With reference to FIG. 7, the third example of the initialization method of the predicted slip amount is described below. In the third example of the initialization method of the predicted slip amount, if a previous print job is finished due to a sheet jam, the predicted slip amount is set larger than the predicted slip amount before the sheet jam.

When starting the initialization of the predicted slip amount, the CPU 38 calculates the default value of the predicted slip amount by procedures that are similar to the procedures illustrated in FIGS. 5 and 6 (step S301). Next, in step S302, the CPU 38 determines whether a previous print job ends by jam.

When the CPU 38 determines that the previous print job ends by jam (YES in step S302), the CPU 38 increases the predicted slip amount in step S303. The end of the previous print job by jam means the actual slip amount of the sheet 4 is greater than the predicted slip amount. Therefore, increasing the predicted slip amount from the value derived by one of the procedures illustrated in FIGS. 5 and 6 decreases an occurrence frequency of the jams. The increased predicted slip amount in this case, for example, may be determined based on the actual slip amount detected by the sheet detector 48 when the previous print job ends by sheet jam. Or, if the sheet detector 48 does not detect the sheet 4 when the previous print job ends by sheet jam, the increased predicted slip amount in this case may be set to double the actual slip amount detected recently by the sheet detector 48.

Next, in step S304, the CPU 38 calculates the interval between the toner images based on the predicted slip amount increased in step S303 and ends the initialization of the predicted slip amount.

When the CPU 38 determines the previous print job does not end by jam (NO in step S302), the CPU 38 proceeds to step S304 without proceeding to step S303.

A First Example of the Calculation Method of the Predicted Slip Amount

Figure 8:
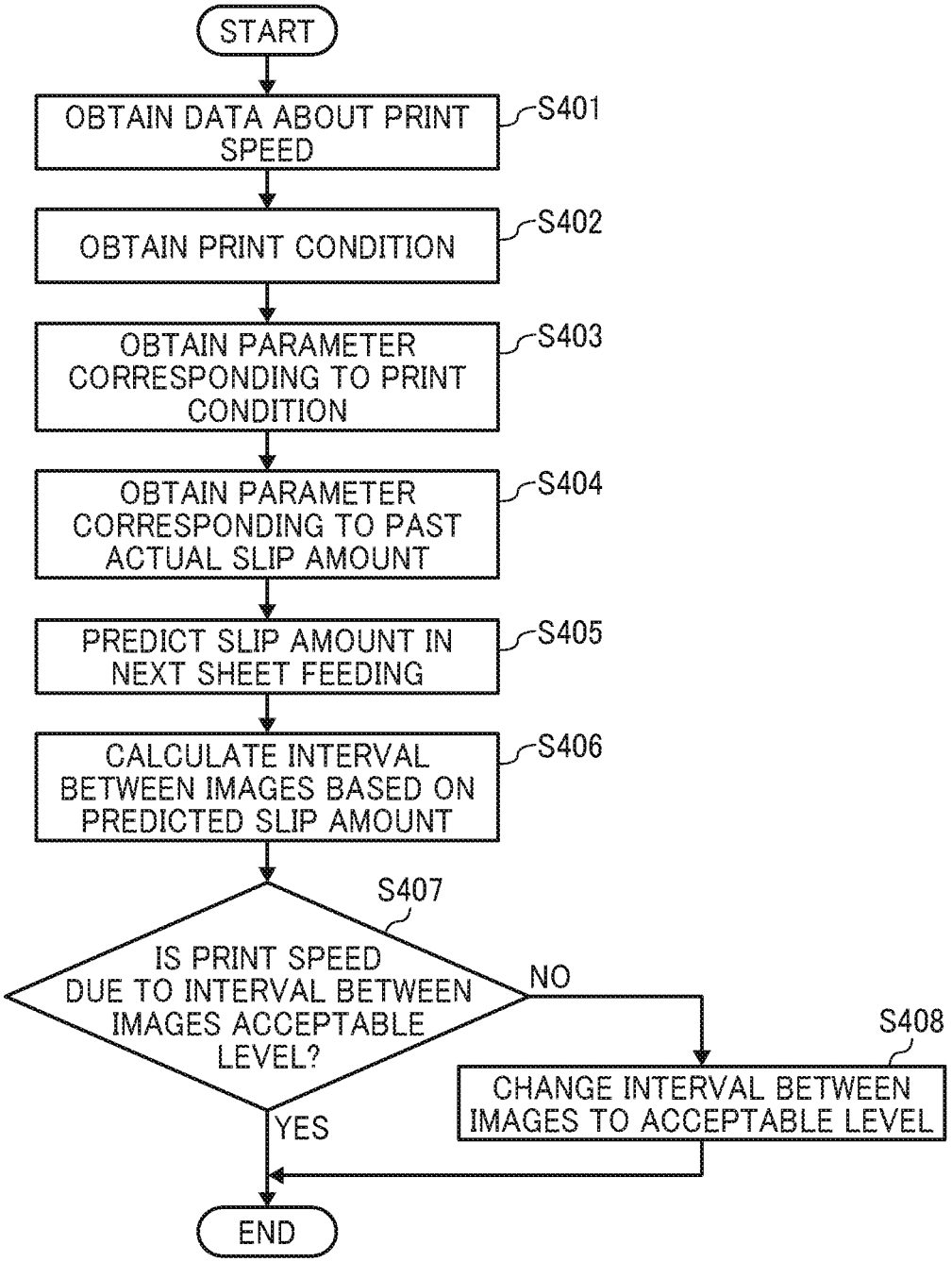
FIG. 8 is a flowchart illustrating a process flow of the image forming apparatus considering an actual slip amount in the image forming apparatus according to embodiments of the present disclosure.

With reference to FIG. 8, the first example of the calculation method of the predicted slip amount is described below. In the first example of the calculation method of the predicted slip amount, firstly the predicted slip amount corresponding to the print condition is predicted. If the difference between the predicted slip amount and the actual slip amount is greater than a predetermined value, the predicted slip amount for the next sheet feeding is predicted and corrected.

When starting the calculation of the predicted slip amount, the CPU 38 obtains the data about the print speed of the image forming apparatus 100 from the controller 47 (step S401). The data about the print speed of the image forming apparatus 100 may be changed by the control of the present embodiment. Therefore, the CPU 38 obtains the data about the print speed of the image forming apparatus 100 in each initialization.

Next, the CPU 38 obtains the print condition such as the linear velocity of the feeding roller that feeds the sheet 4, the paper type of the sheet 4, and the temperature and the humidity inside the image forming apparatus 100 (step S402). The CPU 38 determines the linear velocity of the feeding roller based on a diameter of the feeding roller and a number of revolutions (a number of revolutions of the feeding motor 49) of the feeding roller. The CPU 38 may obtain the temperature and the humidity of the sheet 4 from the temperature and humidity sensor 52. The CPU 38 may obtain the paper type of the fed sheet 4 from the controller 47.

Next, in step S403, the CPU 38 obtains a parameter for the prediction of the slip amount corresponding to the print condition. The parameter for the prediction of the slip amount is a parameter used for the prediction of the slip amount under the print condition that is gotten in step S402. For example, a slip amount parameter and an offset value of the predicted slip amount corresponding to the print condition are considered. As an example of the slip amount parameter, the slip amount parameter corresponding to an environmental condition is considered that the slip amount parameter in a low temperature and a low humidity sets 2 times than the one in a normal temperature and a normal humidity, and the slip amount parameter in a high temperature and a high humidity sets 1.5 times than the one in the normal temperature and the normal humidity.

Next, in step S404, the CPU 38 obtains a parameter for the prediction of the slip amount corresponding to a past actual slip amount. Obtaining the parameter for the prediction of the slip amount corresponding to the past actual slip amount enables to obtain the predicted slip amount corresponding to an actual movement of the sheet 4. The parameter is set to increase the predicted slip amount when the actual slip amount increases and to decrease the predicted slip amount when the actual slip amount decreases. This setting prevents unnecessary increase of the predicted slip amount and results in minimum decrease of the print speed of the image forming apparatus 100.

Next, in step S405, the CPU 38 predicts the slip amount in the next sheet feeding. The prediction for the slip amount in the next sheet feeding is carried out based on the parameter for the prediction of the slip amount gotten in steps S403 and S404. Using the parameters related to the actual sheet movement and the change of the print condition enables high accuracy prediction of the slip amount.

Next, in step S406, the CPU 38 calculates the interval between the toner images based on the predicted slip amount determined in step S405. The calculation of the interval between the toner images is carried out by the following procedure. The CPU 38 calculates a default value of the interval between the toner images based on the data about the print speed gotten in step S401. Next, based on the calculated default value of the interval between the toner images and the interval between the sheets 4 during sheet feeding, the CPU 38 calculates the maximum slip amount that does not change the interval between the toner images. If the predicted slip amount is larger than the maximum slip amount, the interval between the toner images is set larger. If the predicted slip amount is not larger than the maximum slip amount, the interval between the toner images is set the default value of the interval between the toner images.

Next, in step S407, the CPU 38 determines whether the print speed that becomes slower due to the larger interval between the toner images is acceptable. When the print speed becomes slower due to the larger interval between the toner images caused by the predicted slip amount, whether the slower print speed (e.g., a deceleration rate in the print speed) is acceptable depends on a user and a system. Whether the slower print speed is acceptable may be determined by comparing with a predetermined acceptable deceleration rate. The acceptable deceleration rate may be changed in accordance with the print condition or the like.

When the CPU 38 determines that the slower print speed due to the larger interval between the toner images is an acceptable level (YES in step S407), the CPU 38 ends the calculation of the predicted slip amount.

Conversely, when the CPU 38 determines that the slower print speed due to the larger interval between the toner images is not the acceptable level (NO in step S407), the CPU 38 changes the interval between the toner images to the acceptable level (step S408) and ends the calculation of the predicted slip amount. When the print speed becomes an unacceptable low speed, the CPU 38 sets the interval between the toner images to realize an acceptable print speed.

Second Example of the Calculation Method of the Predicted Slip Amount

Figure 9A:
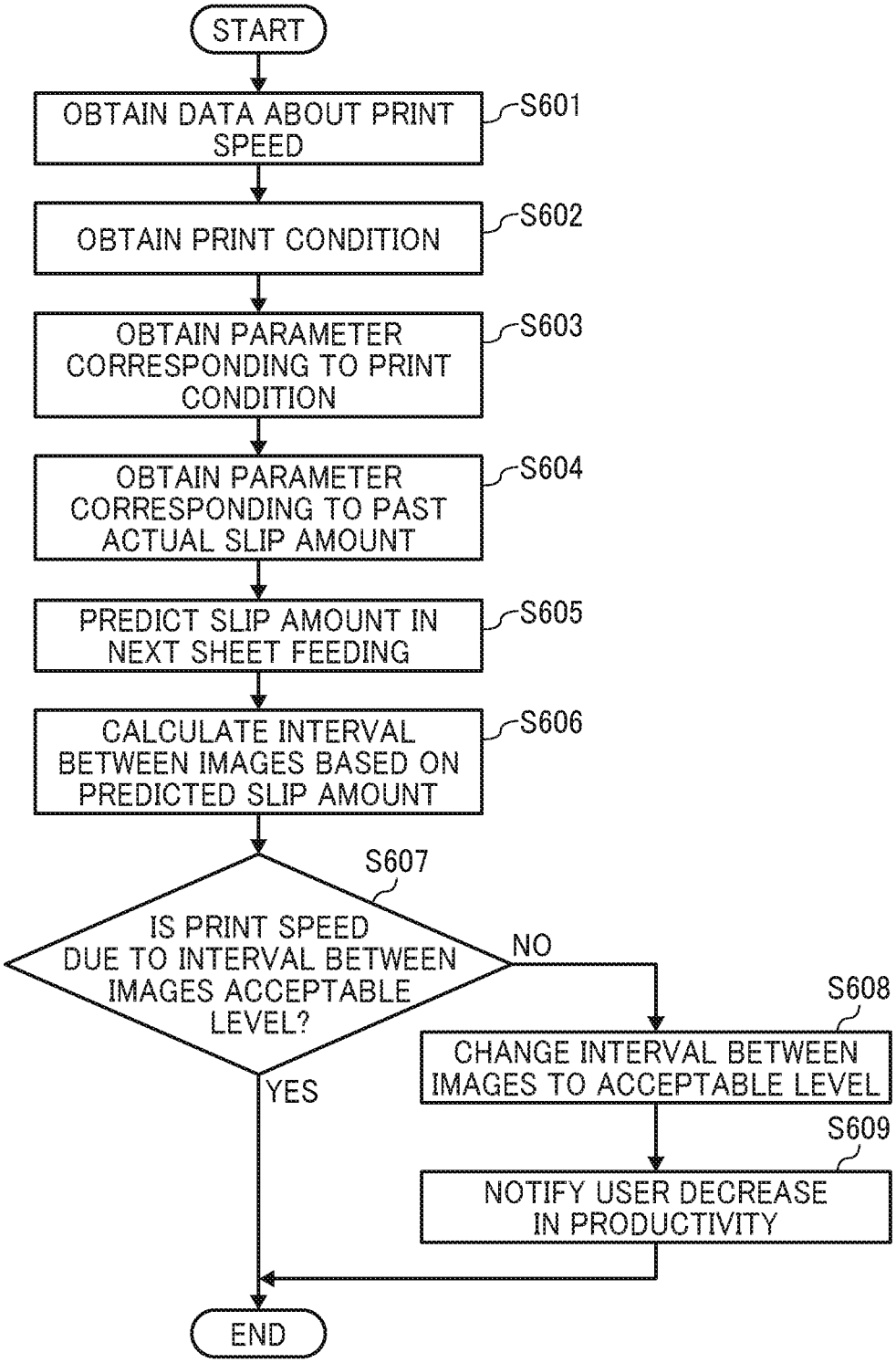
FIG. 9A is a flowchart illustrating a process flow of the image forming apparatus according to embodiments of the present disclosure including a notification process to a user.

With reference to FIG. 9A, the second example of the calculation method of the predicted slip amount is described below. A feature of the second example is adding a process to address a case in which the low print speed due to the larger interval between the toner images is determined to be unacceptable to the first example.

Because steps S601 to S608 illustrated in FIG. 9A are the same as steps S401 to S408 illustrated in FIG. 8, a description thereof is omitted. In the second example of the calculation method of the predicted slip amount, after the CPU 38 changes the interval between the toner images to realize the print speed acceptable level (S608), the user of the image forming apparatus 100 is notified a potential of a decrease in the print speed, that is, a productivity, due to the jam caused by the slip of the sheet 4 (step S609). The unacceptable decrease in the print speed is likely to be caused by a bad printing environment or a bad quality sheet. In such a case, a warning to the user can lead to an improvement of the productivity.

The warning is, for example, a transmission of an e-mail to a person who requests printing or a supervisor of the image forming apparatus 100 used by the user, displaying a necessary warning on a display part of the control panel 43 of the image forming apparatus 100, generating a warning sound from the image forming apparatus 100, or the like.

A printing action may be changed as well as the warning to the user. The printing action is, for example, stopping printing and waiting the user's operation, warning the user and continuing printing but decreasing to the lowest possible print speed, which is under the print speed acceptable level but prevents occurring the jam.

Third Example of the Calculation Method of the Predicted Slip Amount

Figure 9B:
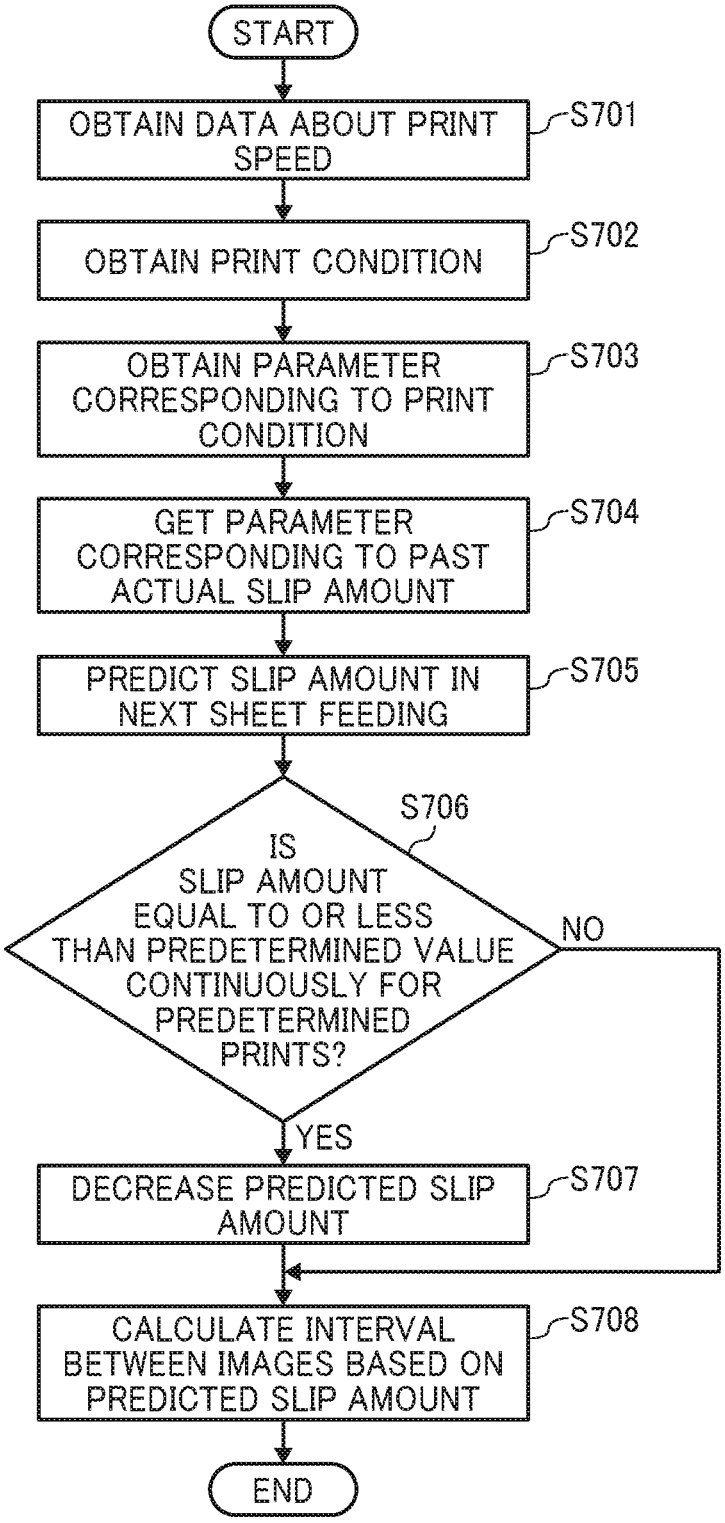
FIG. 9B is a flowchart illustrating a slip amount control flow in the image forming apparatus according to embodiments of the present disclosure when a slip amount is stable during printing after jam.

With reference to FIG. 9B, a description is given of the third example of the calculation method of the predicted slip amount. A feature of the third example of the calculation method of the predicted slip amount is decreasing the predicted slip amount when the slip amount is within a predetermined range for a predetermined number of prints after the jam, which is performed after the process of the predicted slip amount about the jam illustrated in FIG. 7

Because steps S701 to S705 illustrated in FIG. 9B are the same as steps S401 to S405 illustrated in FIG. 8, a description thereof is omitted. Subsequently to step S705, the CPU 38 determines whether the slip amount keeps being equal to or less than a predetermined value continuously for a predetermined number of prints after the previous jam (step S706). The predetermined value of the slip amount and the predetermined number of prints after the previous jam are determined experimentally. However, for example, the predetermined number of prints after the previous jam may be from 10 to 20 prints and the predetermined value of the slip amount may be the limit value that does not decrease the print speed. When a determination result in step S706 is YES, the CPU 38 decreases the predicted slip amount (step S707) because the previous jam is considered an irregular jam and a big slip of the sheet 4 is predicted non-recurrent. In step S708, the CPU 38 calculates the interval between the toner images based on the predicted slip amount. When the determination result in step S706 is NO, the CPU 38 calculates the interval between the toner images based on the predicted slip amount determined by steps S701 to S705 (step S708).

Figure 10:
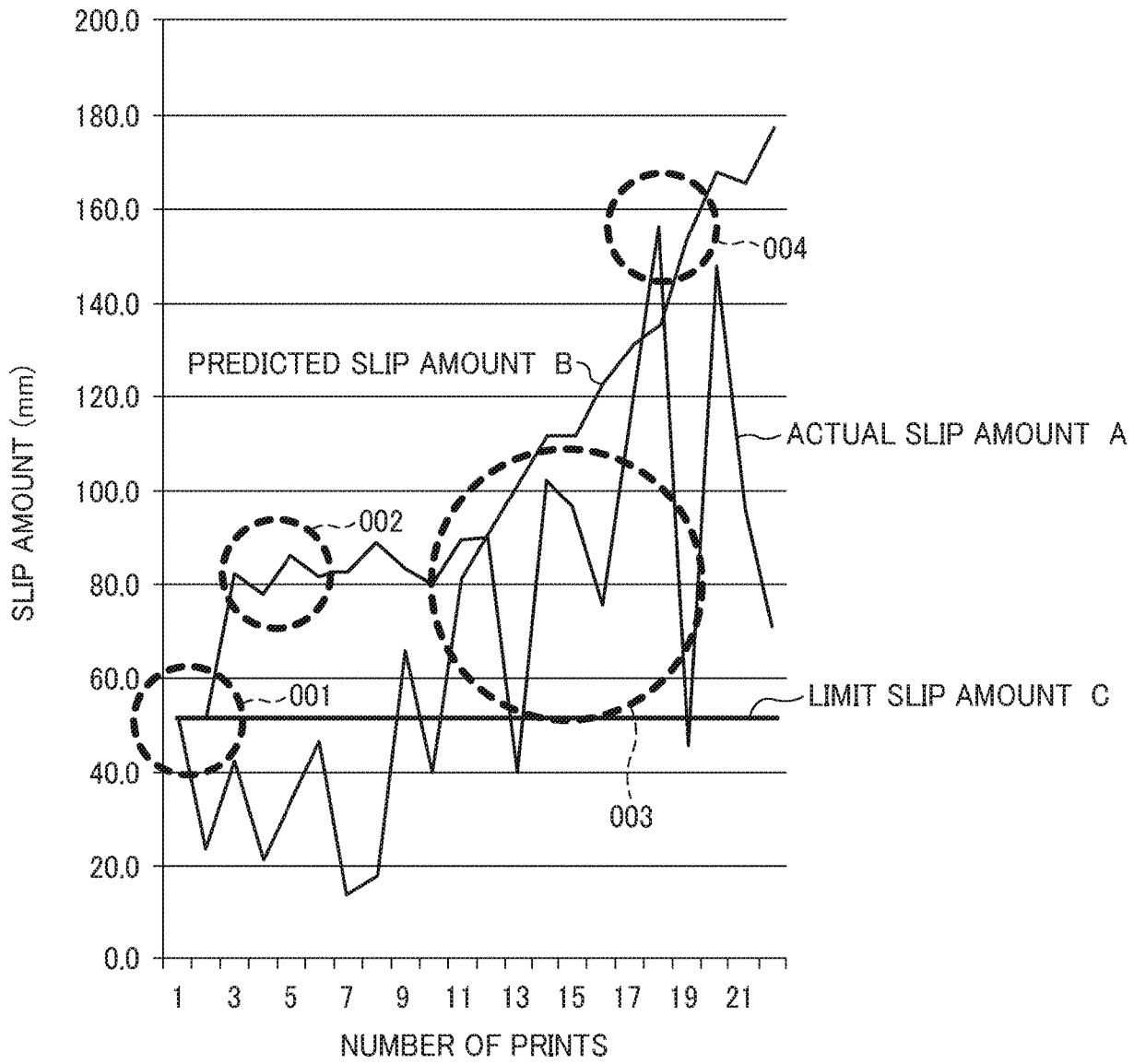
FIG. 10 is a graph illustrating changes of a predicted slip amount and an actual slip amount in a print job of the image forming apparatus according to embodiments of the present disclosure.

With reference to FIG. 10, a description is given of change of the predicted slip amount corresponding to the actual slip amount and a print action with the prediction of the slip amount.

FIG. 10 illustrates the actual slip amount with line A, the predicted slip amount with line B, and a limit slip amount that attains a target print speed with line C. The limit slip amount that attains the target print speed means the limit value of the predicted slip amount that does not decrease the print speed of the image forming apparatus 100. As illustrated by a region marked 001 in FIG. 10, the predicted slip amount of a first print and a second print of this example is initialized to be the limit value of the predicted slip amount that does not decrease the print speed of the image forming apparatus 100.

The predicted slip amounts of a third print and after the third print are, as illustrated by a region marked 002 in FIG. 10, greater than the limit value of the predicted slip amount that does not decrease the print speed of the image forming apparatus 100. Based on the predicted slip amount, the interval between the toner images, that is, the distance between the toner images on the intermediate transfer belt 5 serving as an image bearer, is set larger than before. Therefore, even if the sheet 4 slips in a sheet feeding path, an occurrence of the jam is suppressed.

As illustrated by a region marked 003 in FIG. 10, even when the actual slip amount is larger than the limit value of the predicted slip amount that does not decrease the print speed of the image forming apparatus 100, because the predicted slip amount is larger than the actual slip amount and the interval between the toner images on the image bearer is set larger than before, the occurrence of the jam is suppressed.

On the other hand, as illustrated by a region marked 004 in FIG. 10, when the actual slip amount is larger than the predicted slip amount, the sheet 4 may not catch the toner image on the intermediate transfer belt 5 and a jam might occur.

Figure 11:
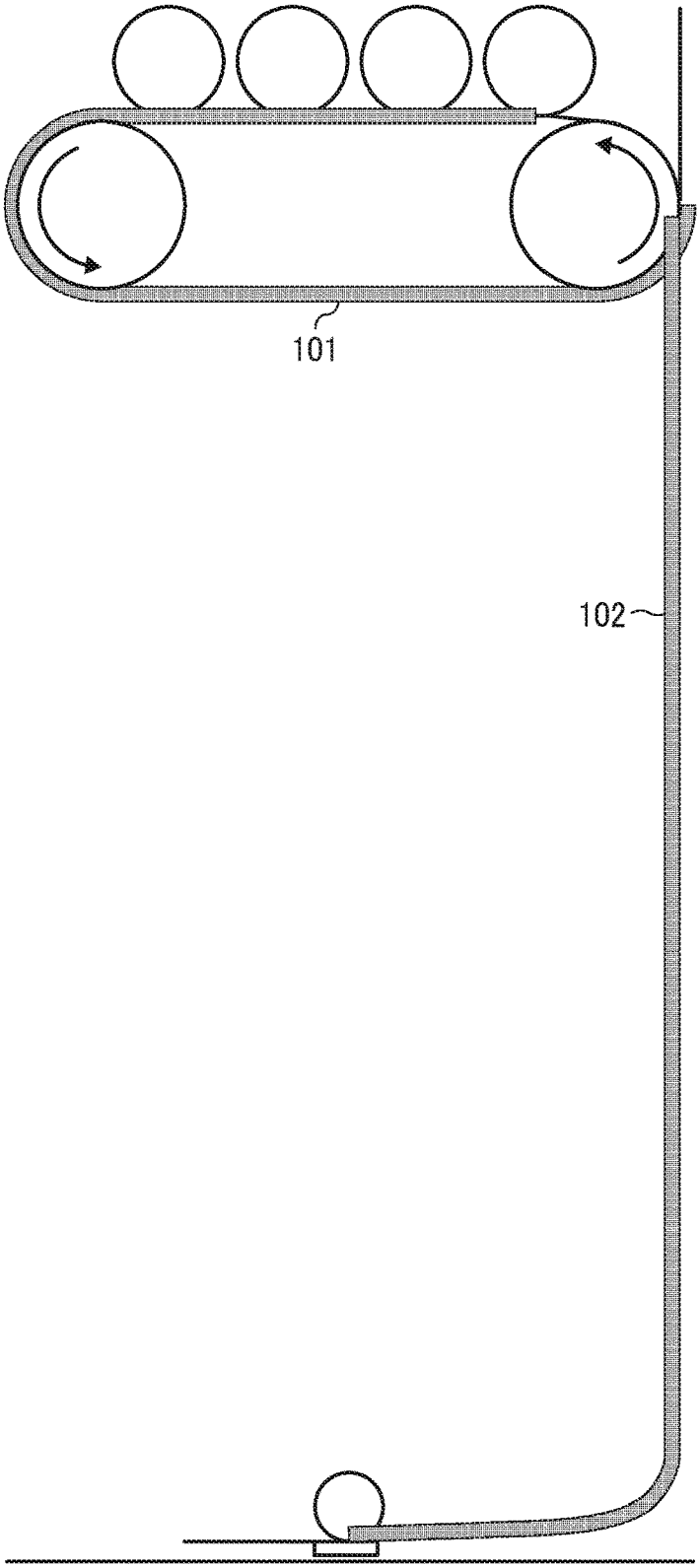
FIG. 11 is a schematic view illustrating a structure of a sheet feeding section and an image forming section in the image forming apparatus that has a sheet feeding length greater than an image conveyance length.

With reference to FIG. 11, a description is given of an image forming method of the image forming apparatus 100 that includes a longer sheet feeding length 102 than an image conveyance length 101 on the intermediate transfer belt 5 serving as an image bearer. The image forming apparatus 100 that includes the longer sheet feeding length 102 than the image conveyance length 101 needs to control a start of sheet feeding in advance of a start of image forming to meet the toner image on the image bearer with the sheet 4 certainly.

Figure 12:
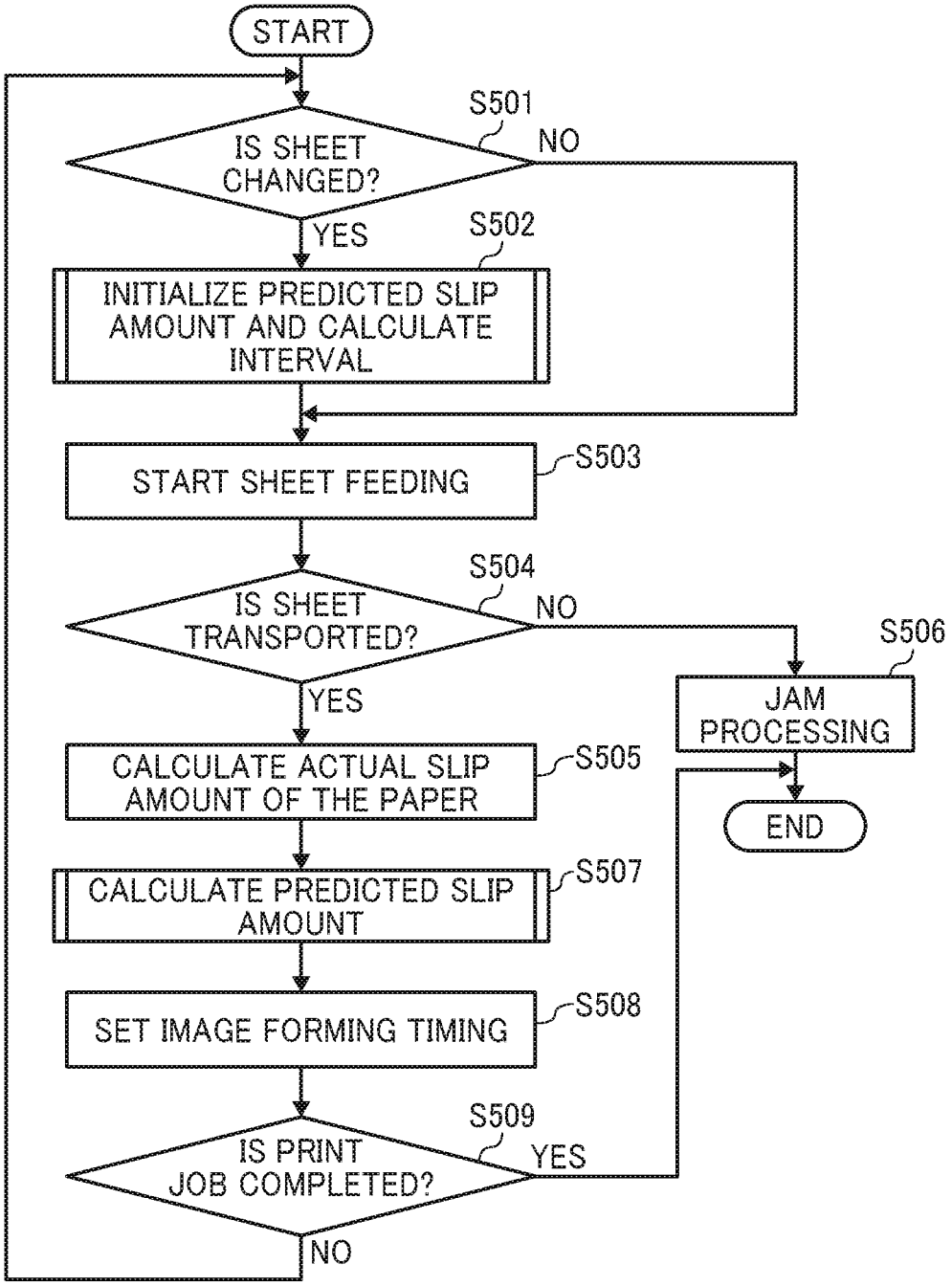
FIG. 12 is a flowchart illustrating a process flow of the image forming apparatus illustrated in FIG. 11.

FIG. 12 illustrates a control procedure about the image forming apparatus 100 that includes the longer sheet feeding length 102 than the image conveyance length 101. As illustrated in FIG. 12, after a print start is requested from the control panel 43, the CPU 38 determines whether the sheet 4 is changed (step S501). For example, the CPU 38 determines that the sheet 4 is changed when the print start is requested after the sheet tray 1 is pulled out and set, a power switch of the image forming apparatus 100 is turned on, or the like. Specifically, the CPU 38 determines whether the sheet 4 is a first sheet for printing after the print start is requested after the sheet tray 1 is pulled out and set or the power switch of the image forming apparatus 100 is turned on.

When the sheet 4 is changed (YES in step S501), there is a strong possibility of the change about the sheet 4, that is, the change of the paper type or the sheet set position. The change of the sheet 4 about the paper type or the sheet set position results in the change of the print condition used for the prediction of the slip amount of the sheet 4. There is a possibility that the prediction of the slip amount based on the print condition before the change of the sheet 4 result in low prediction accuracy. Therefore, when the sheet 4 is changed, the CPU 38 initializes the predicted slip amount and calculates the interval between the toner images based on the initialization of the predicted slip amount (step S502). A detailed description regarding the initialization is provided referring to FIG. 4.

After the initialization of the predicted slip amount and the calculation of the interval between the toner images, the CPU 38 rotates feeding rollers for feeding the sheet 4 including the feed roller 2 and the separation roller 3, and starts sheet feeding (step S503).

Next, the CPU 38 determines whether the sheet detector 48 detects transportation of the sheet 4 within a predetermined time after the start time of the sheet feeding (step S504). When the sheet detector 48 detects the transportation of the sheet 4 within the predetermined time after the start time of the sheet feeding (YES in S504), the CPU 38 calculates the actual slip amount of the sheet 4 in step S505 and the predicted slip amount in step S507.

The CPU 38 sets the image forming timing in step S508. After setting the image forming timing, the CPU 38 determines whether a print job is completed in step S509. If the print job is completed, the CPU 38 ends this process (YES in step S509). If the print job is not completed, the CPU 38 returns to step S501 (NO in step S509).

When the sheet detector 48 does not detect the transportation of the sheet 4 within the predetermined time after the start time of the sheet feeding (NO in step S504), the CPU 38 determines that a jam has occurred, proceeds to jam processing in step S506, and ends a series of processes.

A detailed processing in each step is the same as the description in FIG. 4 and is omitted to avoid overlap.

Thus, the image forming apparatus 100 that includes the longer sheet feeding length 102 than the image conveyance length 101 can meet the image forming on the image bearer with the sheet 4.

The embodiment described above is an example of the image forming apparatus 100 that employs the electrophotography. However, the present disclosure is not limited to this type of image forming apparatus, and is also applicable to other image forming apparatuses that form an image using developer, such as a copier, a facsimile machine, and a multifunction peripheral.

Figure 13A:
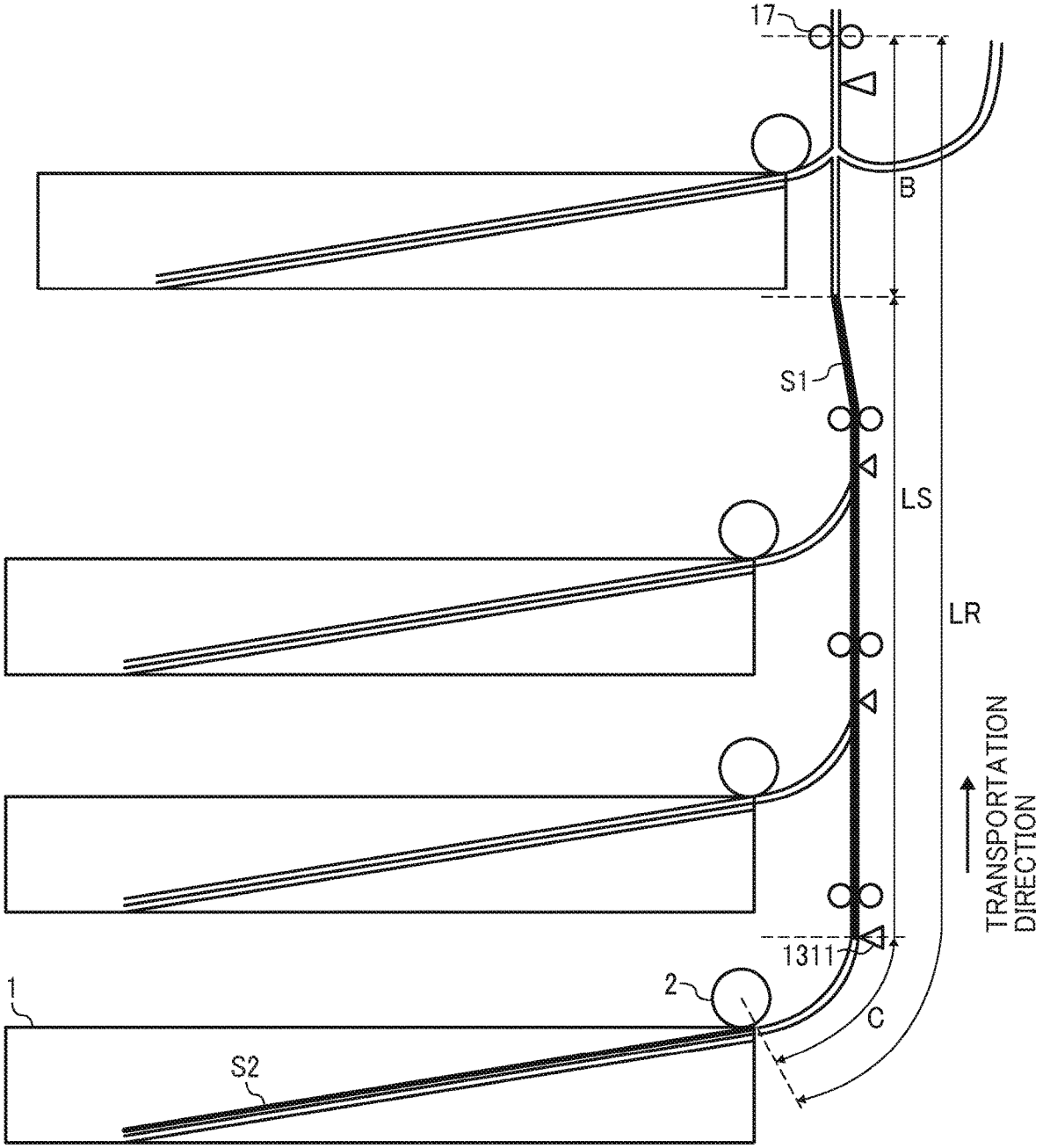
FIG. 13A is an explanatory diagram for illustrating a previous sheet influence on a following sheet when the previous sheet stops at a position of a registration roller pair and illustrating distance of some regions.
Figure 13B:
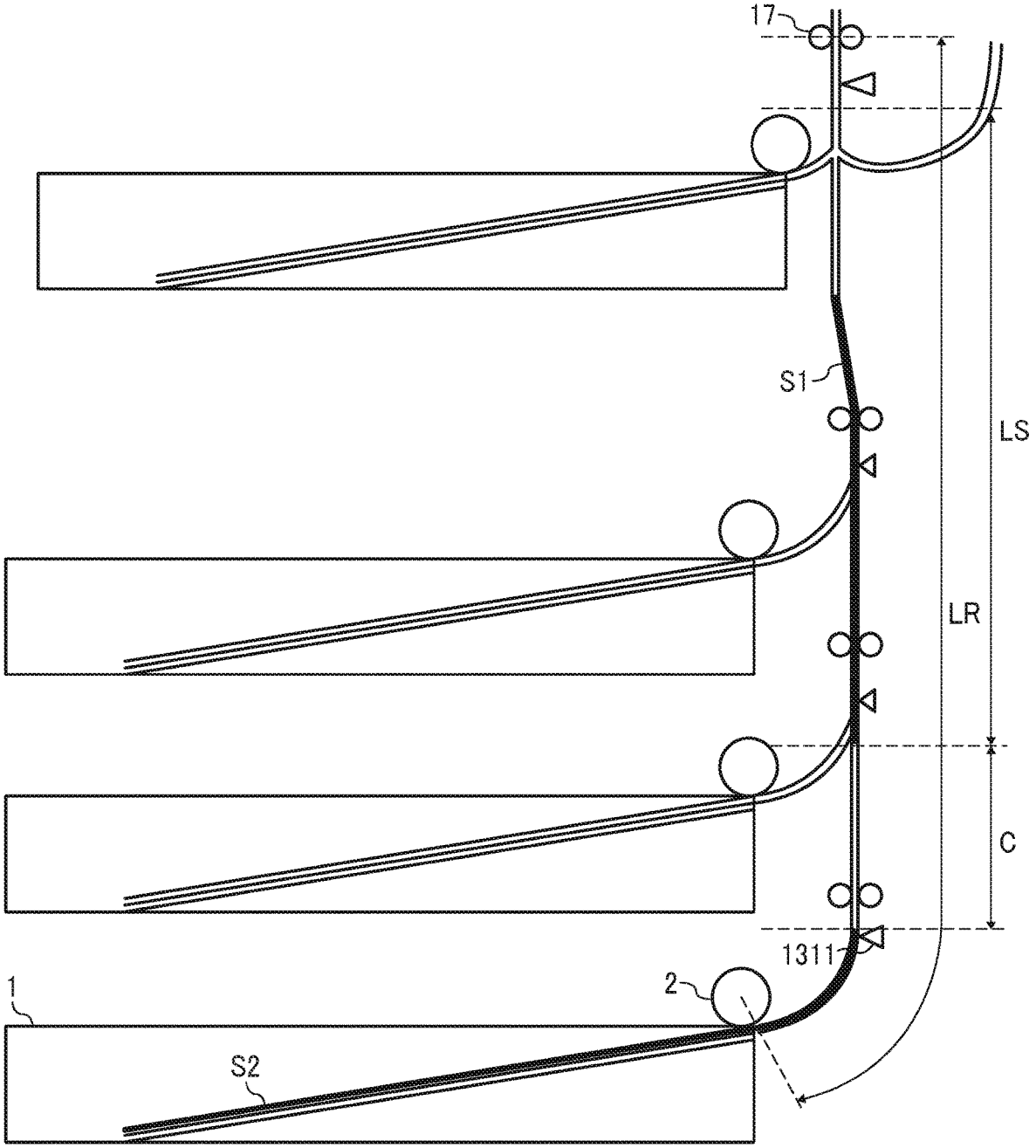
FIG. 13B is an explanatory diagram illustrating a situation in which two or more sheets exist and do not stop at the position of the registration roller pair.

Example Considering a Delay of the Following Sheet Due to a Stop of the Previous Sheet at the Registration Roller Pair With reference to FIGS. 13A and 13B, a description is given of how the stop of a previous sheet S1 at the registration roller pair 17 affects a following sheet S2. FIG. 13A illustrates a sheet length LS in a transportation direction of the sheet 4 and a distance LR from the feed roller 2 that is one of the feeding rollers to feed the sheet 4 to the registration roller pair 17. The distance LR means a distance in which the sheet 4 moves for a time from start time of sheet feeding to stop time of sheet moving at a position of the registration roller pair 17. Furthermore, FIG. 13A illustrates a distance C from the feed roller 2 to a bank sensor 1311. The bank sensor 1311 detects passing of a rear edge of the sheet 4. When the bank sensor 1311 detects passing of the rear edge of the previous sheet S1, the next following sheet S2 is fed by the feed roller 2. Therefore, the distance C illustrated in FIG. 13A means a distance between sheets by sheet feeding.

When a transportation time of the sheet 4 moving the distance LR is longer than a transportation time of the sheet 4 moving the sheet length LS and the distance C between the sheets 4, two or more sheets 4 not stopping at the position of the registration roller pair 17 may exist in a feed path upstream from the registration roller pair 17 (a region defined by the distance LR in FIG. 13B). This situation is illustrated in FIG. 13B. In this case, when the previous sheet S1 stops at the position of the registration roller pair 17, an above described machine structure may need stopping a sheet feeding of the following sheet S2 at the same time.

Figure 14:
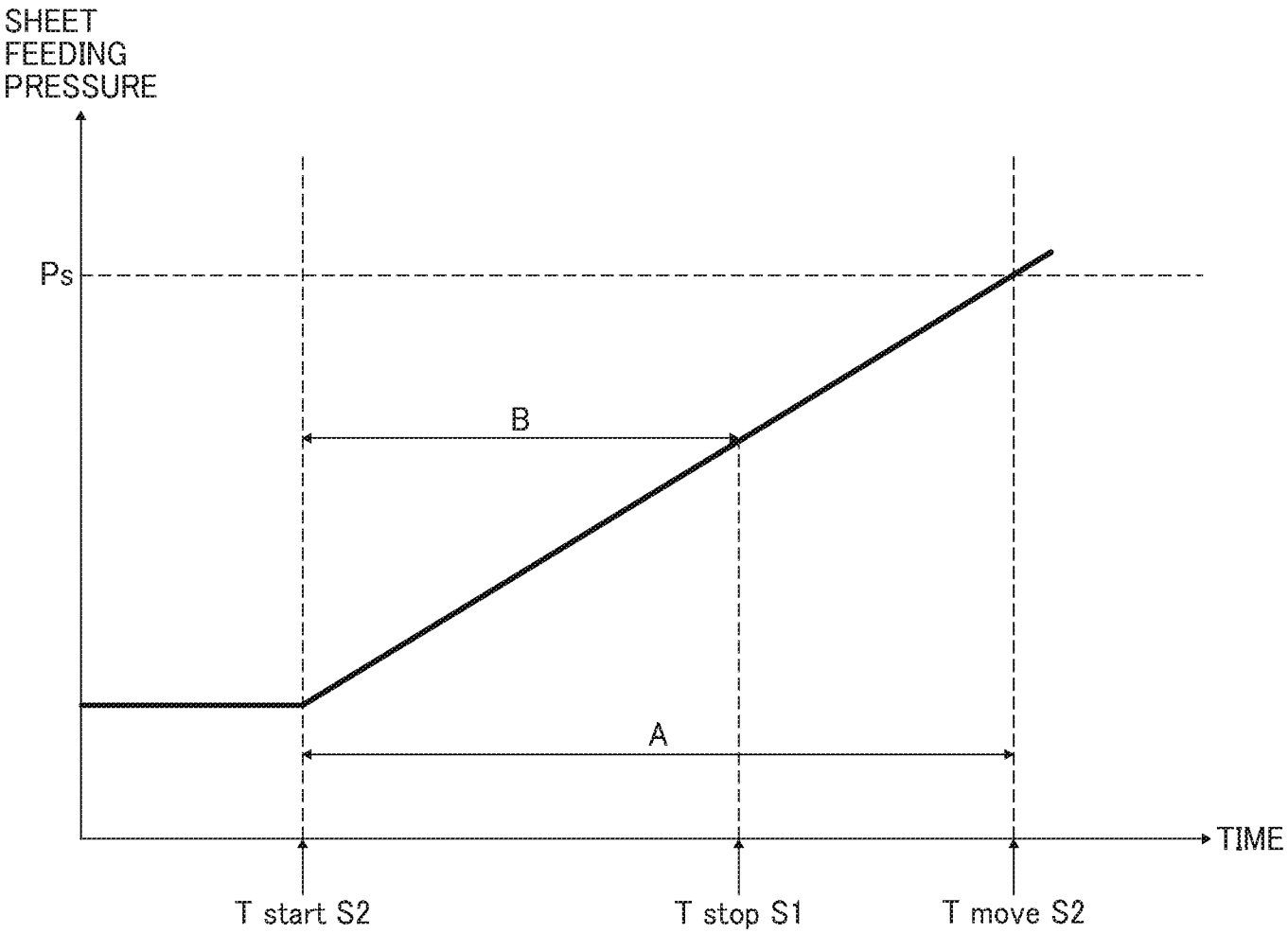
FIG. 14 is a graph illustrating a relationship between a time from a start of a sheet feeding to a start of a sheet moving and sheet feeding pressure.

A sheet feeding by the feed roller 2 needs a sheet feeding pressure exerted to the sheet 4, which is greater than or equal to a predetermined pressure to move the sheet 4. FIG. 14 illustrates a sheet feeding pressure Ps with which the sheet 4 starts moving. As illustrated in FIG. 14, it takes a time A written in FIG. 14 for the sheet feeding pressure of the following sheet S2 to become the sheet feeding pressure Ps from a start timing (T start S2) of the sheet feeding of the following sheet S2. When the previous sheet S1 stops at the position of the registration roller pair 17 during the sheet feeding of the following sheet S2, the sheet feeding of the following sheet S2 also stops. Stopping the sheet feeding means the sheet feeding pressure returns to a starting situation. To restart the sheet feeding from the starting situation, the sheet feeding pressure needs to be increased from the starting situation again. As a result, an unpredicted sheet feeding time is added to an original sheet feeding time. The sheet 4 may not catch the toner image on the intermediate transfer belt 5.

As described above, a delay that is difficult to measure occurs when the time A in FIG. 14, that is, the time from the start timing of the sheet feeding of the following sheet S2 to the start timing of the sheet moving of the following sheet S2 (T move S2) is longer than a time B in FIG. 14, that is, the time from the start timing of the sheet feeding of the following sheet S2 to a stop timing of the sheet moving of the previous sheet S1 at the position of the registration roller pair 17 (T stop S1). To avoid the delay, it is preferable that the start timing of the sheet feeding of the following sheet S2 is not set while the previous sheet S1 stops at the position of the registration roller pair 17 and is set after the stop timing and a restart timing of moving the previous sheet S1. Setting the timing as described above makes possible to control the sheet feeding timing accurately.

However, in the timing as described above, the start timing of the sheet feeding of the following sheet S2 is later than an original timing. The following sheet S2 may not catch the toner image on the intermediate transfer belt 5. Therefore, the delay of the following sheet S2 needs to be reflected to the interval between the toner images by adding the delay of the following sheet S2 to the predicted slip amount described above.

Figure 15:
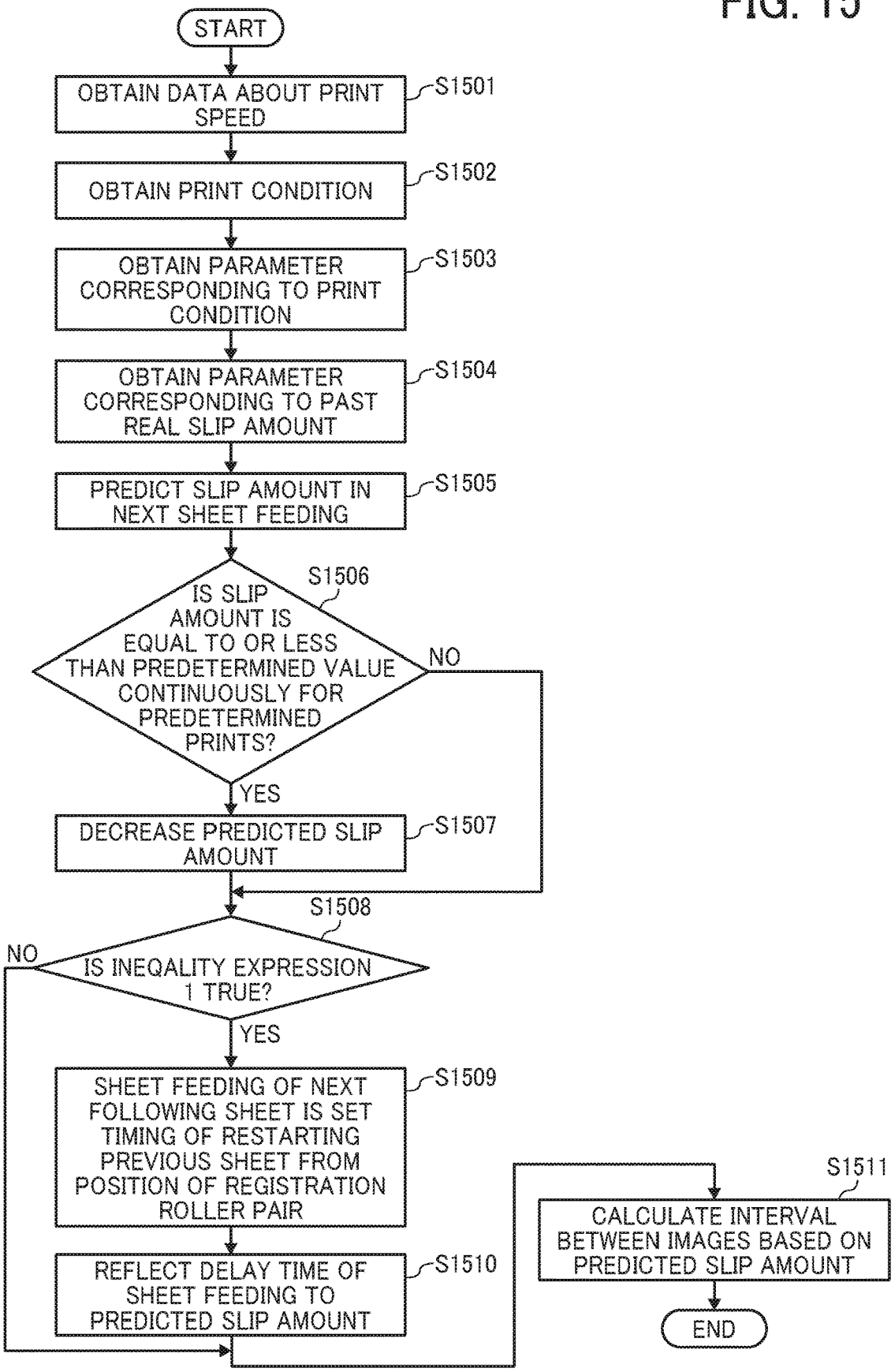
FIG. 15 is a flowchart illustrating a control about the following sheet when the previous sheet stops at the position of the registration roller pair.

FIG. 15 is a flowchart illustrating the control process described above. Steps S1501 to S1507 are the same as steps S701 to S707 illustrated in FIG. 9B.

In step S1508, the CPU 38 determines whether the following inequality expression is true.

[(the transportation time of the sheet 4 moving from the feed roller 2 to the registration roller pair 17 (the distance *LR*))−(the transportation time of the sheet 4 moving the sheet length *LS* and the distance *C* between sheets 4)]<(the time from the start timing of the sheet feeding to the start timing of moving the sheet 4)The inequality expression 1:

When the above inequality expression 1 is true, that is, when the time B illustrated in FIG. 14 is smaller than the time A illustrated in FIG. 14 (YES in step S1508), the start timing of the sheet feeding of the following sheet S2 is set a timing of restarting movement of the previous sheet S1 by a rotation of the registration roller pair 17 (step S1509). The CPU 38 reflects a delay time that occurs from above described change of the start timing to the predicted slip amount (step S1510). How the CPU 38 reflects the delay time is adding the calculated predicted slip amount to the delay time. In step S1511, the CPU 38 calculates the interval between the toner images based on the predicted slip amount that is reflected with the delay time. Step S1511 is the same as step S708 in FIG. 9B. When the above inequality expression 1 is not true (NO in step S1508), the interval between the toner images is calculated based on the predicted slip amount only (step S1511).

Above mentioned control makes it possible to suppress the delay of the sheet 4 to the toner image and vain sheet feeding action. Not making unnecessary sheet feeding makes possible a decrease in driving noise and suppresses abrasion of the feed roller 2.

Figure 16:
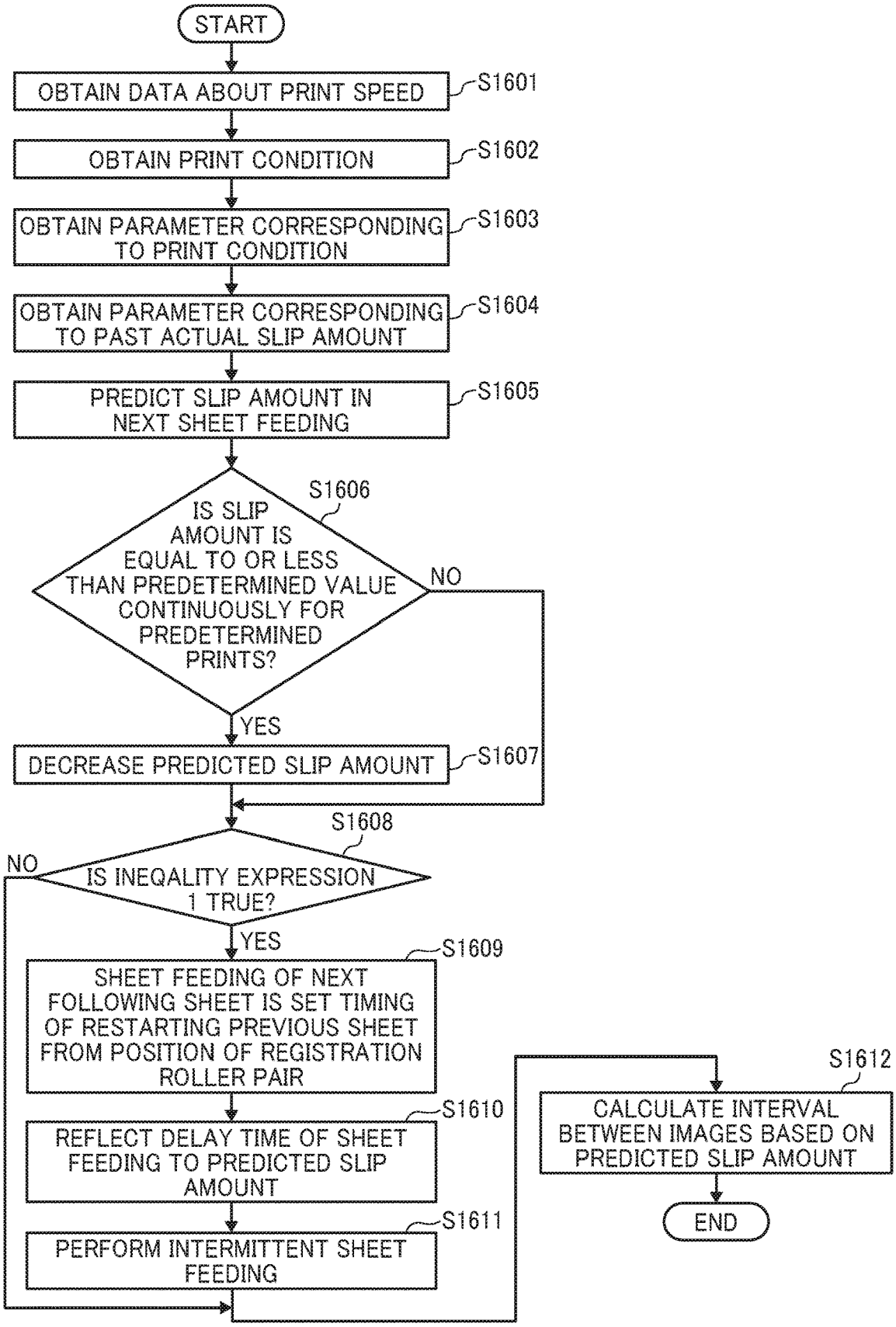
FIG. 16 is a flowchart illustrating a control about the following sheet when the previous sheet stop at the position of the registration roller pair.

FIG. 16 is a flowchart illustrating a control about another action for an improvement of sheet feeding ability.

Steps S1601 to S1610 are the same as steps S1501 to S1510 illustrated in FIG. 15. In an example illustrated in FIG. 16, the CPU 38 controls an intermittent sheet feeding that repeats short time on/off actions of a sheet-feeding clutch and does not make sheet-feeding action (step S1611). The intermittent sheet feeding may suppress a slip of the sheet 4 at the next sheet feeding. Step S1612 is the same as the step S1511.

When the previous sheet S1 stops at the position of the registration roller pair 17 during the start timing of the sheet feeding of the following sheet S2 and the time that the following sheet S2 passes the sheet tray 1 or the feed roller 2, the sheet feeding stops similarly as above. Stopping the sheet feeding results in weakening the sheet feeding pressure in the sheet feeding path from the sheet tray 1. To restart the sheet feeding from the situation that the sheet feeding pressure is weak, the sheet feeding action described above needs to start again from the beginning and move the following sheet S2 stopped at the sheet feeding path. Therefore, the unpredicted sheet feeding time is added to the original sheet feeding time. The inequality expression 1 in steps S1508 and S1608 may be [(a time from the start timing of the sheet feeding of the following sheet S2 to the stop timing of moving the previous sheet S1 at the position of the registration roller pair 17)<(a time from the start timing of the sheet feeding of the following sheet S2 to a time when the following sheet S2 passes the sheet tray 1)]. Above (a time from the start timing of the sheet feeding of the following sheet S2 to a time when the following sheet S2 passes the sheet tray 1) corresponds to the prediction of the slip amount after step S1507 or step S1607.

Thus, the image forming apparatus 100 according to the first embodiment prevents deterioration of image quality.

Second Embodiment

In the image forming apparatus 100 according to the first embodiment illustrated in FIG. 1, when the sheet 4 enters a nip formed between the intermediate transfer belt 5 and the secondary transfer roller 16 (hereinafter called a secondary transfer nip), a collision between the sheet 4 and the secondary transfer nip makes an impact. When the sheet 4 exits the secondary transfer nip, a release of the sheet 4 from a situation sandwiched in the secondary transfer nip also makes impact. The impact vibrates the intermediate transfer belt 5. The vibration is transmitted to the whole of the intermediate transfer belt 5. When the toner image is primarily transferred from each of the photoconductor drums 8BK, 8M, 8C, and 8Y to the intermediate transfer belt 5 during the vibration, a deterioration of the image quality occurs.

To prevent such deterioration, for example, a method is known to decrease the impact by controlling a pressure in the secondary transfer nip according to a thickness of the sheet 4. However, a contact and separation mechanism that controls the pressure in the secondary transfer nip according to the thickness of the sheet 4 increases a number of parts and a cost. The contact and separation mechanism also has an issue about difficulty of miniaturization.

The second embodiment discloses a mechanism that is possible to realize the miniaturization and low cost and suppress the deterioration of the image quality caused by the impact that happens when the sheet 4 enters the secondary transfer nip and exits therefrom.

The image forming apparatus 100 according to the second embodiment controls an image forming timing to avoid primarily transferring the toner image onto the intermediate transfer belt 5 at timing when the sheet 4 enters the secondary transfer nip and exits therefrom. Thus, without controlling the pressure in the secondary transfer nip, it is possible to avoid the impact that happens when the sheet 4 enters the secondary transfer nip and exits therefrom.

Referring now to the drawings, the image forming apparatus 100 according to the second embodiment of the present disclosure is described below. The configuration and the like of the image forming apparatus 100 according to the second embodiment are similar to those of the image forming apparatus 100 according to the first embodiment illustrated in FIGS. 1 to 3. In the following description, adscript letters "C", "M", "Y" and "BK" that mean cyan, magenta, yellow, and black, respectively, are used in necessary cases and generally omitted. For example, the photoconductor drums 8Y, 8M, 8C, and 8BK are described as a photoconductor drum 8.

Figure 17:
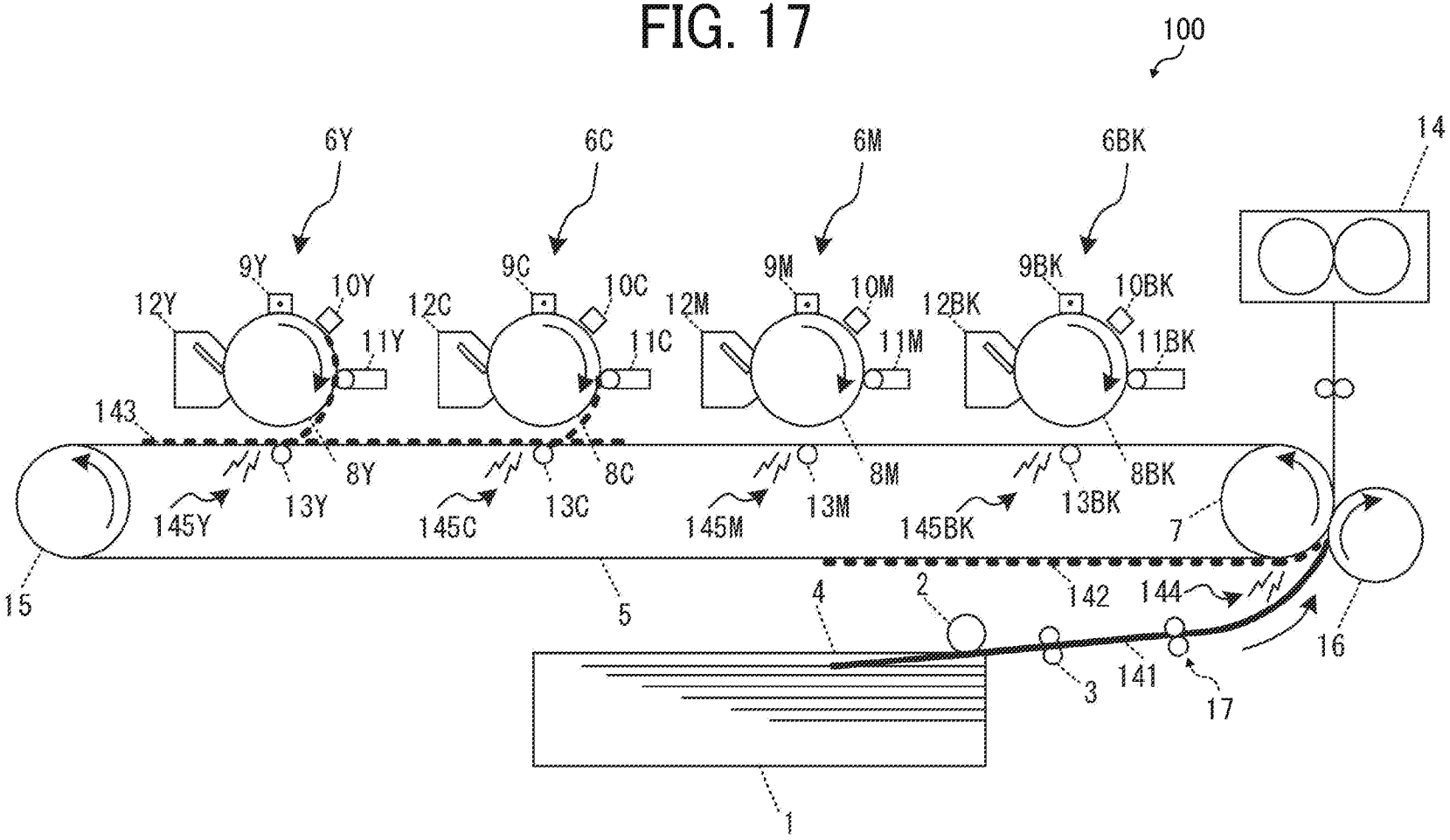
FIG. 17 is an explanatory diagram of a second embodiment of the image forming apparatus, explaining an impact when the sheet enters a secondary transfer nip.

FIG. 17 is an explanatory diagram about the impact that happens when the sheet 4 enters the secondary transfer nip. To transfer a toner image 142 depicted by a thick dashed line to a sheet 141 depicted by a thick solid line, the sheet 141 enters the secondary transfer nip formed between the drive roller 7 and the secondary transfer roller 16. At that time, an impact 144 is added to the intermediate transfer belt 5. The impact 144 is transmitted through the intermediate transfer belt 5 and makes an impact 145 depicted as impacts 145BK, 145M, 145C, and 145Y in FIG. 17 in a nip (hereinafter called a primary transfer nip) between the photoconductor drum 8 and a primary transfer roller 13 depicted as the primary transfer rollers 13BK, 13M, 13C, and 13Y in FIG. 17. If the impact 145 is made while a following toner image 143 is primarily transferred from the photoconductor drum 8 to the intermediate transfer belt 5, a part of the following toner image 143 affected by the impact 145 is stretched or deteriorated.

Figure 18:
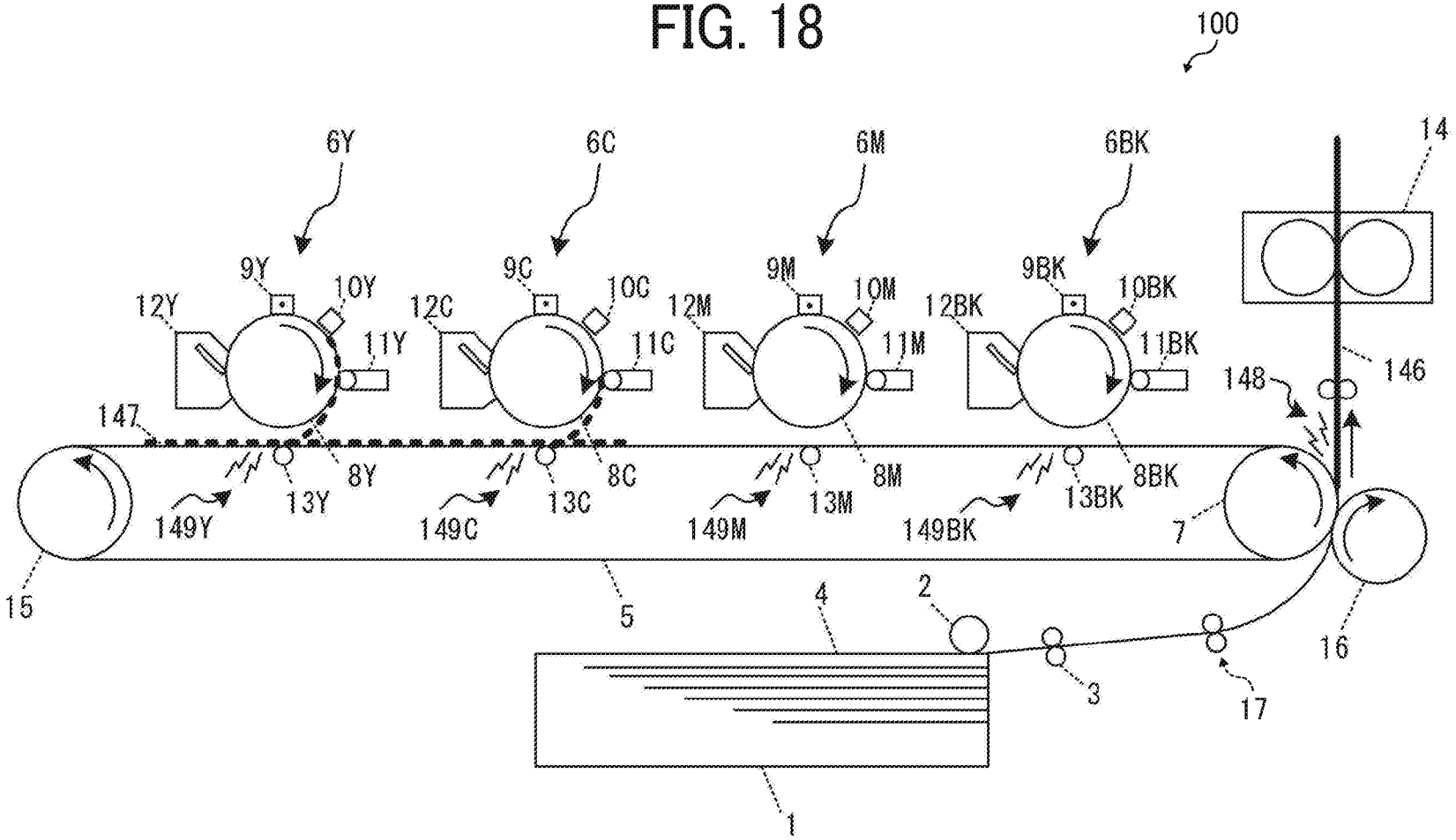
FIG. 18 is an explanatory diagram of the second embodiment of the image forming apparatus, explaining an impact when the sheet exits the secondary transfer nip.

FIG. 18 is an explanatory diagram about the impact that happens when the sheet 4 exits the secondary transfer nip. Similar to the case in FIG. 17, when a sheet 146 exits the secondary transfer nip, an impact 148 is added to the intermediate transfer belt 5. The impact 148 is transmitted through the intermediate transfer belt 5 and makes an impact 149 depicted as impacts 149BK, 149M, 149C, and 149Y in FIG. 18 in the primary transfer nip. If the impact 149 is made while a following toner image 147 is primarily transferred from the photoconductor drum 8 to the intermediate transfer belt 5, a part of the following toner image 147 affected by the impact 149 is stretched or deteriorated.

Figure 19A:
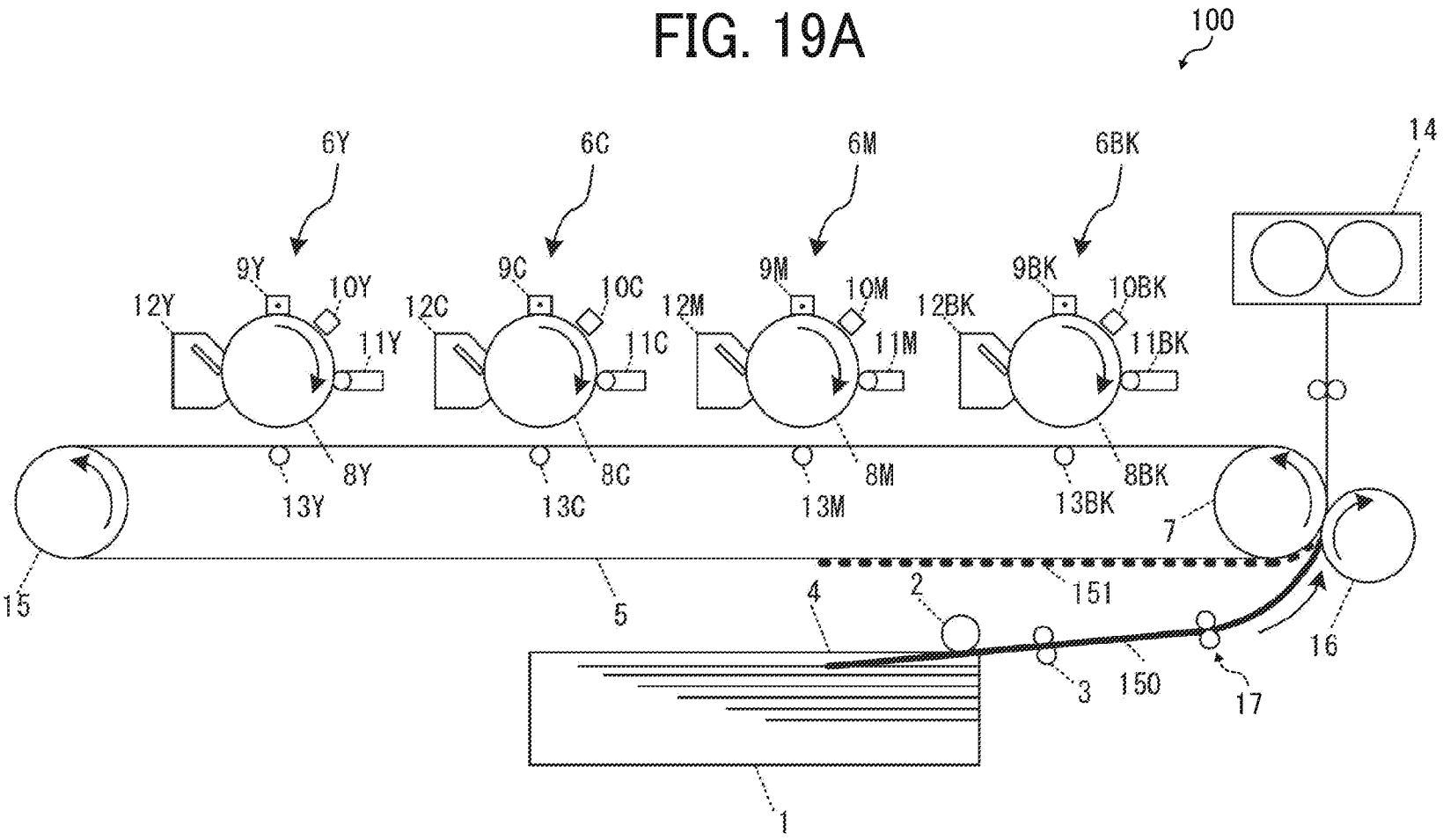
FIG. 19A is an explanatory diagram of a first method of the second embodiment of the image forming apparatus to avoid the impact at the secondary transfer nip.
Figure 19B:
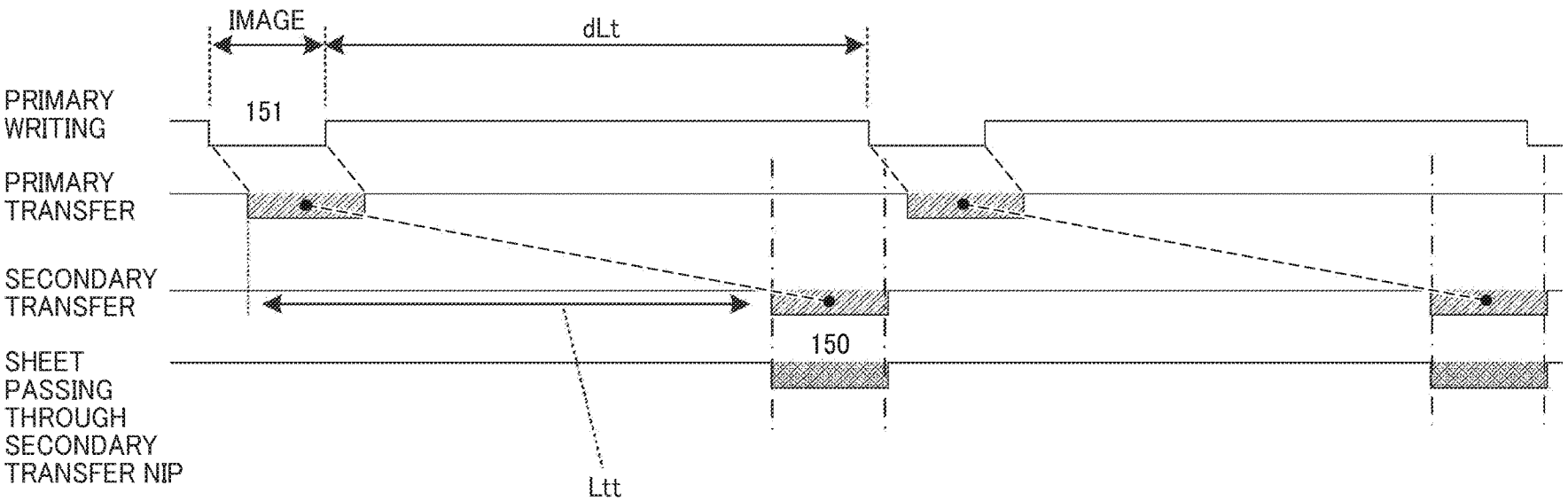
FIG. 19B is a timing chart of the first method of the second embodiment of the image forming apparatus to avoid the impact at the secondary transfer nip.

FIGS. 19A and 19B illustrate explanatory diagrams of a first method to avoid the impact at the secondary transfer nip. FIG. 19A is a schematic diagram illustrating the status of the image forming apparatus 100 carrying out the first method. FIG. 19B is a timing chart illustrating a timing of an image writing signal, a primary transfer timing, a second transfer timing, and a timing at which the sheet 4 passes through the secondary transfer nip.

In the first method, the CPU 38 controls an exposure timing of the LED head 10 and sets the interval between the toner images on the photoconductor drum 8 such that a one toner image is transferred onto the intermediate transfer belt 5, that is, the toner image to be transferred onto one side of the sheet 4 is transferred onto the intermediate transfer belt 5. When a sheet 150 enters the secondary transfer nip and exits therefrom, a following toner image is not transferred onto the intermediate transfer belt 5 because there is one toner image 151 on the intermediate transfer belt 5. Therefore, the impact does not affect the toner image. The CPU 38 controls an exposure timing of the LED head 10 such that a leading edge of the following toner image reaches the primary transfer nip immediately after the sheet 150 passes through the secondary transfer nip.

FIG. 19B is the timing chart illustrating the above. To simplify a description, a yellow toner image is formed in this embodiment. "IMAGE WRITING" in FIG. 19B means an image writing timing by the LED head 10Y. The LED head 10Y writes an electrostatic latent image on the photoconductor drum 8Y located downstream from the photoconductor drums 8BK, 8M, and 8C in a rotation direction of the intermediate transfer belt 5. The image writing timing corresponds to a writing signal called generally F-Gate signal. "PRIMARY TRANSFER" in FIG. 19B means a timing of the primary transfer of the yellow toner image at the primary transfer nip of the primary transfer roller 13Y. "SECONDARY TRANSFER" in FIG. 19B means a timing of the secondary transfer of the yellow toner image at the secondary transfer nip. "SHEET PASSING THROUGH SECONDARY TRANSFER NIP" in FIG. 19B means a timing at which the sheet 150 passes through the secondary transfer nip. As illustrated in the timing chart of FIG. 19B, the CPU 38 controls the exposure by the LED head 10Y to avoid the primary transfer timing illustrated by hatching in the "PRIMARY TRANSFER" of FIG. 19B from each of a rise timing and a decay timing of the secondary transfer illustrated by an alternate long and short dash line in the "SECONDARY TRANSFER" of FIG. 19B. The CPU 38 controls the exposure by the LED head 10Y hereinbefore not to make the primary transfer at the timing when the sheet 150 enters the secondary transfer nip and exits therefrom. This control action is the same as other methods described below.

Here, let dL be an interval between toner images. Let dLt be a time corresponding to the interval dL. Let Lt be a distance between the primary transfer roller 13Y and the secondary transfer roller 16. Let Ltt be a time corresponding to the distance Lt. The CPU 38 determines the interval dL between the toner images that meets a relationship ($dL \geq Lt$) and an interval of the writing timing by the LED head 10Y based on the interval dL, a rotational speed of the photoconductor drum 8Y, and a transportation speed of the intermediate transfer belt 5.

Figure 20A:
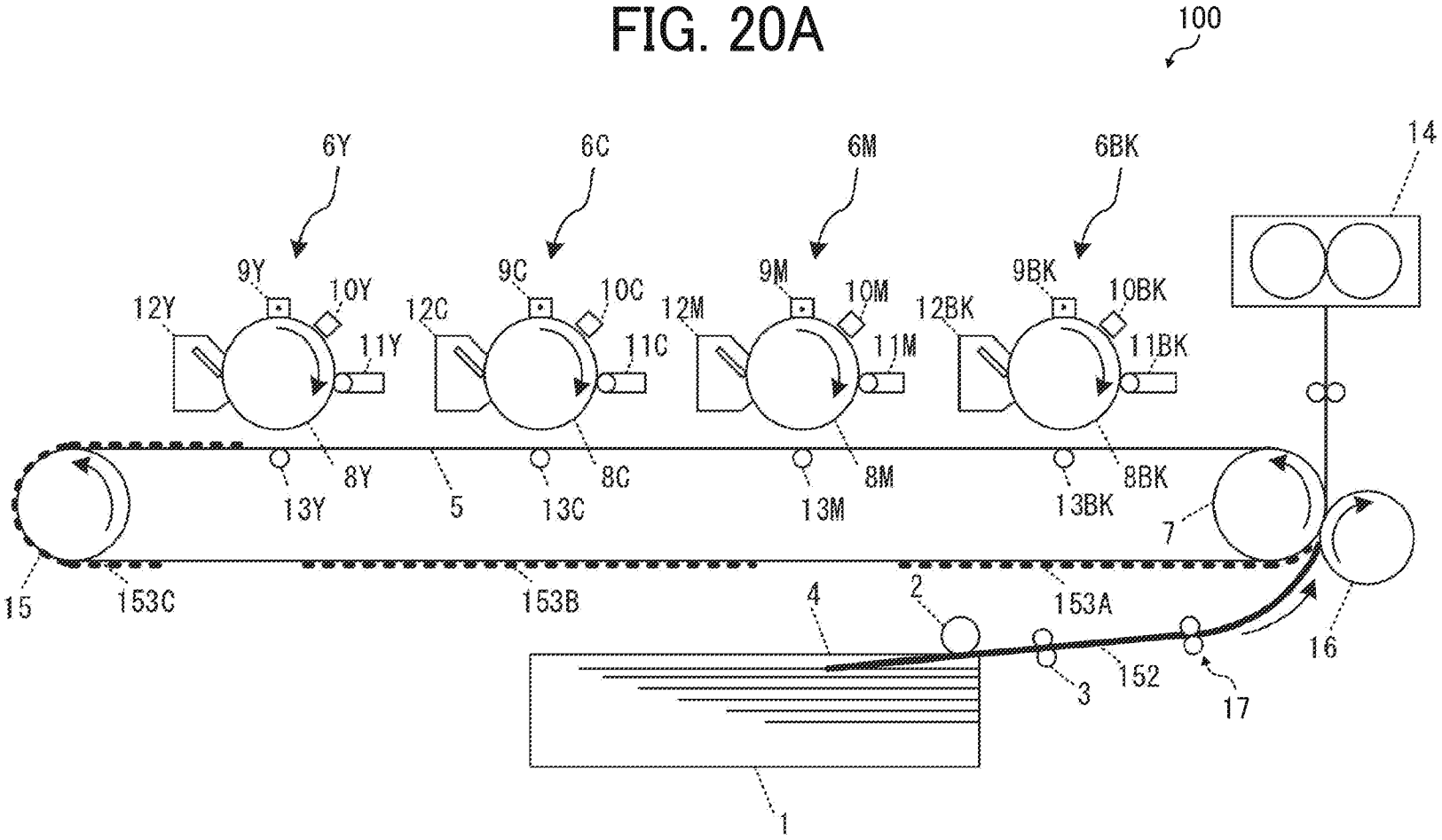
FIG. 20A is an explanatory diagram of a second method of the second embodiment of the image forming apparatus to avoid the impact at the secondary transfer nip.
Figure 20B:
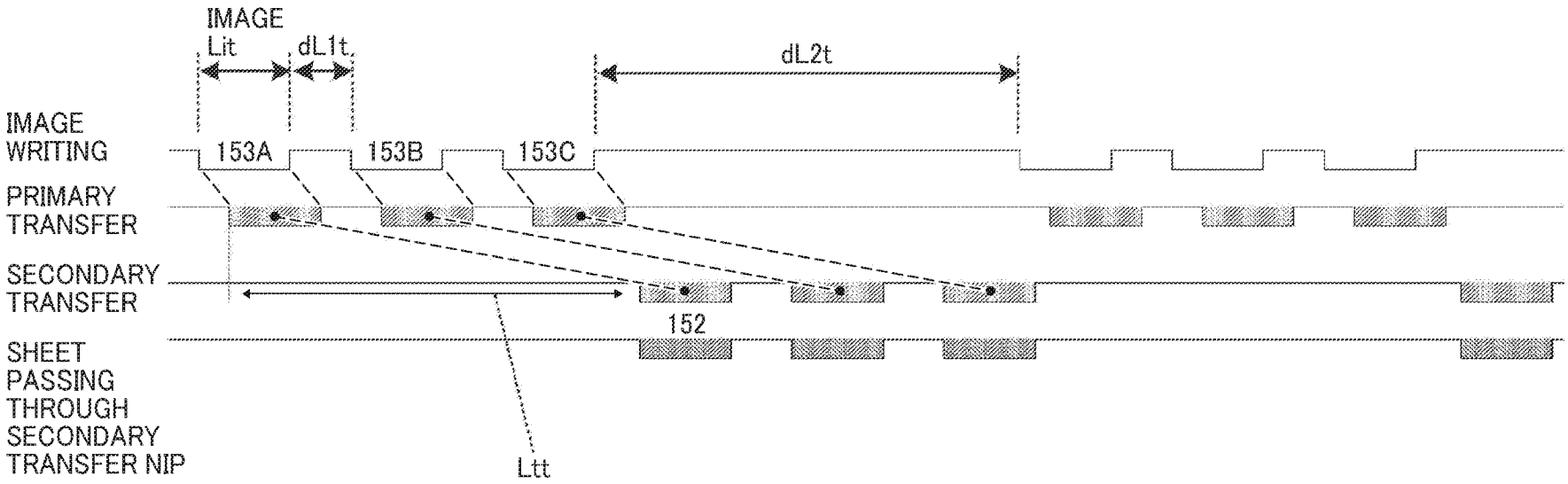
FIG. 20B is a timing chart of the second method of the second embodiment of the image forming apparatus to avoid the impact at the secondary transfer nip.

FIGS. 20A and 20B illustrate explanatory diagrams of a second method to avoid the impact at the secondary transfer nip. In this second method, the CPU 38 forms toner images continuously as long as the toner images fit into a distance between the most downstream transfer roller 13Y and the secondary transfer nip. Subsequently, the CPU 38 controls the exposure by the LED head 10 not to make the primary transfer until these toner images are secondarily transferred. In FIG. 20A, three toner images 153A, 153B, and 153C are transferred to the intermediate transfer belt 5. The CPU 38 controls the exposure by the LED head 10Y to form continuously the toner images 153A, 153B, and 153C with a smallest interval therebetween that is needed for a transportation control of the sheets 4. When a sheet 152 enters the secondary transfer nip and exits therefrom, the toner images 153A, 153B, and 153C have been primarily transferred and therefore are immune from the impact. A leading edge of a following toner image after the toner image 153C is transferred onto the intermediate transfer belt 5 immediately after a sheet 4 transferred with the toner image 153C passes through the secondary transfer nip. This means the CPU 38 controls the exposure by the LED head 10Y to inhibit writing until the sheet 4 transferred with the toner image 153C passes through the secondary transfer nip. Here, a transfer determent time is defined as a time from a timing at which a sheet 4 to be transferred with the first toner image 153A enters the secondary transfer nip to a timing at which a sheet 4 having been transferred with the last toner image 153C exits therefrom.

FIG. 20B is a timing chart illustrating the second method. In FIG. 20B, let Li be a length of the toner image in a direction of transportation. Let Lit be a time corresponding to the length Li. Let dL1 be an interval between the toner images during the primary transfer not including the transfer determent time. Let dL1t be a time corresponding to the interval dL1. Let dL2 be an interval between the toner images during the primary transfer including the transfer determent time. Let dL2t be a time corresponding to the interval dL2. Let Lt be a distance between the primary transfer roller 13Y that is located downstream from the primary transfer rollers 13BK, 13M, and 13C in the rotation direction of the transfer belt 5 and the secondary transfer roller 16. Let Ltt be a time corresponding to the distance Lt. The elements illustrated in FIG. 20B are the same as those in FIG. 19B. For example, "SHEET PASSING THROUGH SECONDARY TRANSFER NIP" in FIG. 20B means a timing at which the sheet 152 passes through the secondary transfer nip. Let n be a number of the toner images formed continuously (n=3 in FIG. 20A). The CPU 38 determines the distance dL1 between the toner images to meet a relationship $[(n\times Li)+((n-1)\times dL1)]\leq Lt$. Furthermore, the interval dL2 between the toner images after the toner image enters the secondary transfer nip satisfies a relationship of $dL2\geq Lt$ like in the first method described above. The CPU 38 determines an interval of the exposure timing based on the above conditions, a transportation speed of the intermediate transfer belt 5, and a rotational speed of the photoconductor drum 8Y.

Figure 21A:
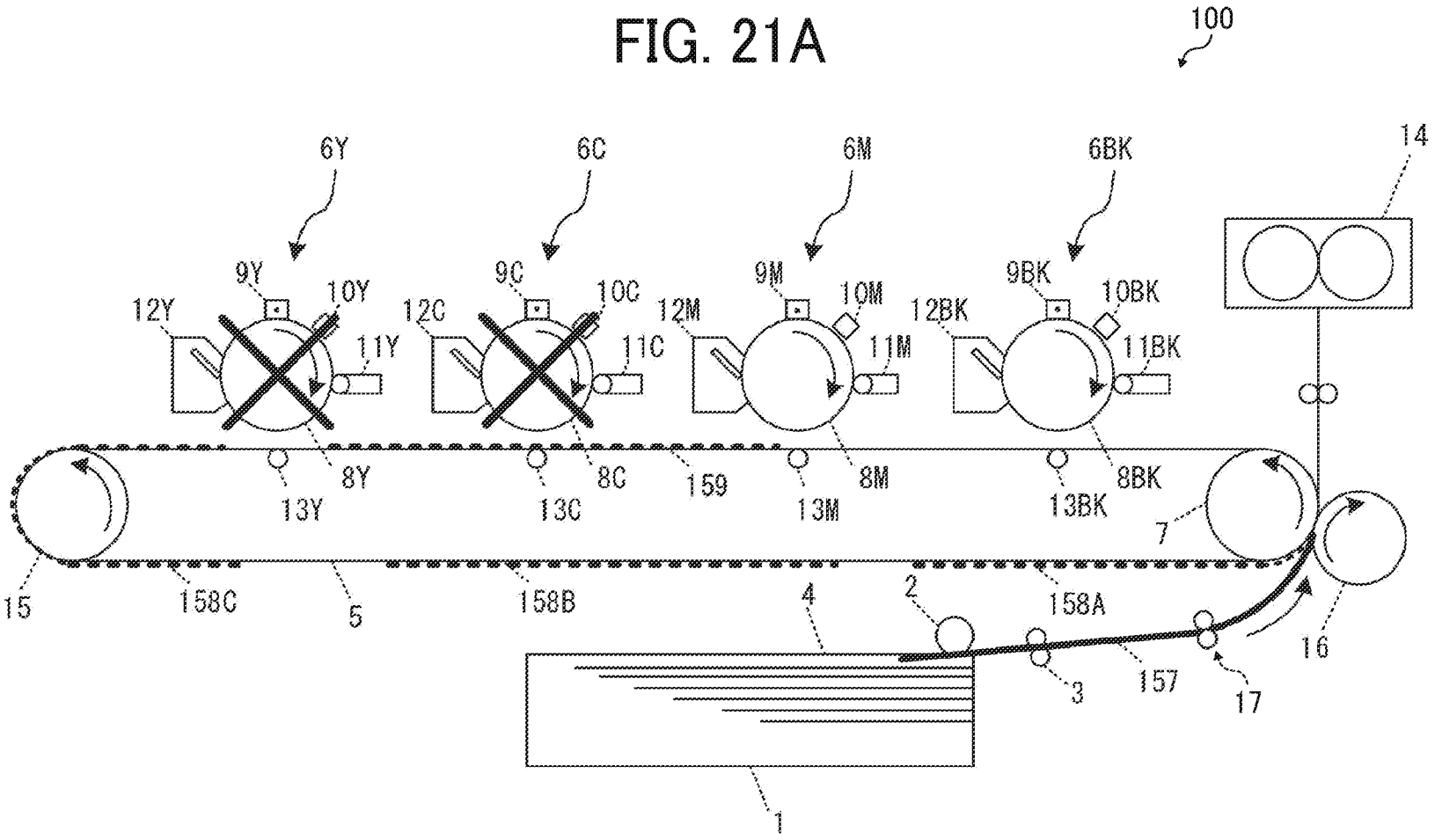
FIG. 21A is an explanatory diagram of a third method of the second embodiment of the image forming apparatus to avoid the impact at the secondary transfer nip.
Figure 21B:
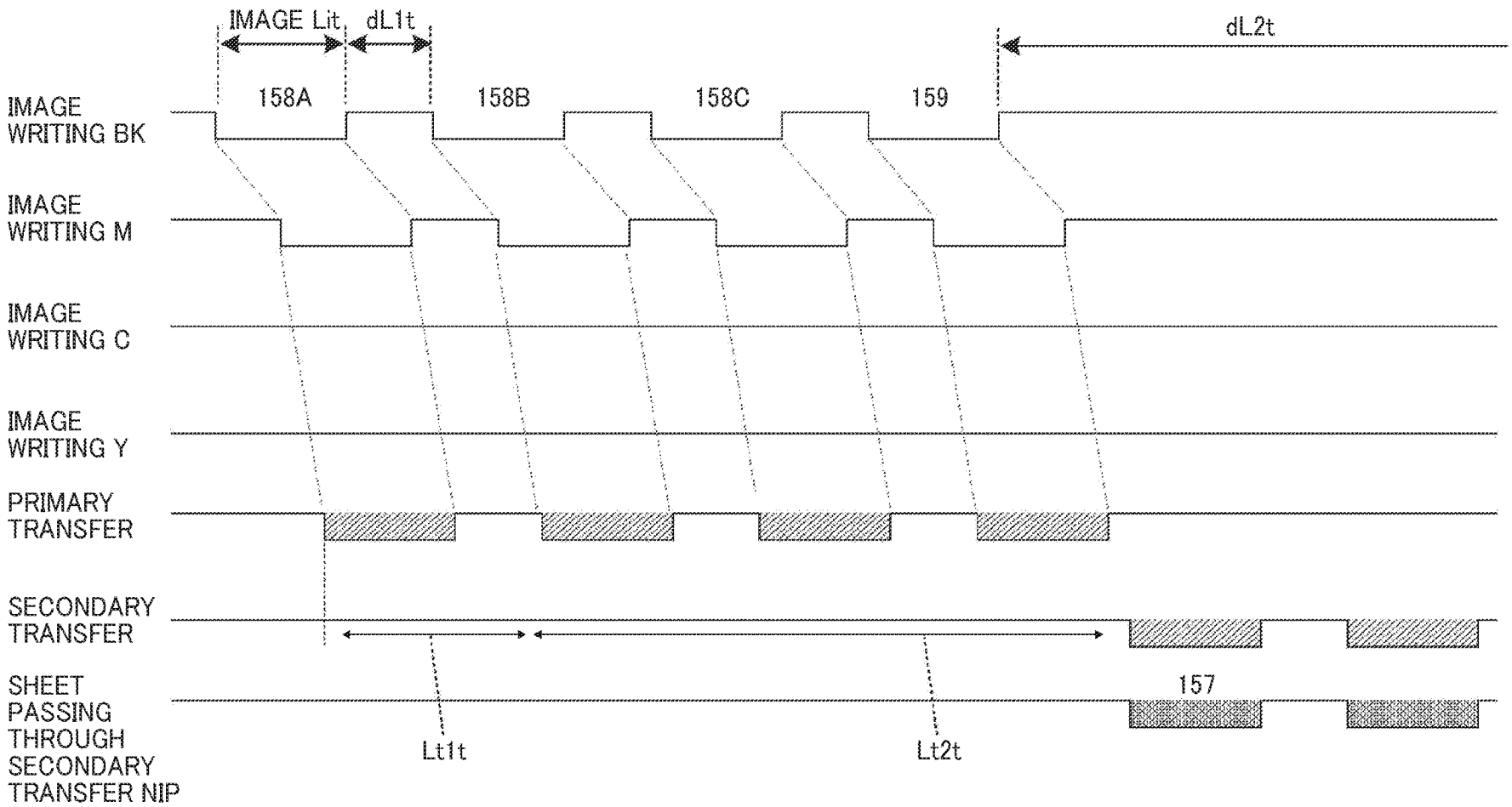
FIG. 21B is a timing chart of the third method of the second embodiment of the image forming apparatus to avoid the impact at the secondary transfer nip.

FIGS. 21A and 21B illustrate explanatory diagrams of a third method to avoid the impact at the secondary transfer nip. The image forming apparatus 100 according to the present embodiment allows forming a toner image with a color designated by the user and does not allow forming a toner image with other colors (hereinafter called a color designated print). The third method describes a control about an interval between the toner images in the color designated print.

In the color designated print, only the designated image forming device 6 forms the toner image. An example in FIG. 21A uses only the image forming devices 6BK and 6M disposed upstream from the image forming devices 6C and 6Y in the rotation direction of the intermediate transfer belt 5 and does not use the image forming devices 6C and 6Y disposed downstream from the image forming devices 6BK and 6M in the rotation direction of the transfer belt 5. In this case, the impact that is made when a sheet 157 enters the secondary transfer nip and exits therefrom does not affect the primary transfer of the cyan toner image and the yellow toner image because the primary transfer rollers 13C and 13Y do not work. Therefore, compared with the second method, the distance that makes it possible to form toner images before the sheet 157 enters the secondary transfer nip is a lengthened distance between the primary transfer roller 13M and the secondary transfer nip. As illustrated in FIG. 21A, toner images 158A, 158B, 158C, and 159 may be made on the intermediate transfer belt 5. The third method controls the exposure of the LED head 10 to obtain rid of waste from productivity by changing the number of toner images formed continuously based on the designated color of the toner image or the content of the toner image.

FIG. 21B is a timing chart illustrating the example in FIG. 21A. In FIG. 21B, let Li be a length of the toner image in the direction of transportation. Let Lit be a time corresponding to the length Li. Let dL1 be an interval between the toner images during the primary transfer not including the transfer determent time. Let dL1t be a time corresponding to the interval dL1. Let dL2 be an interval between the toner images during the primary transfer including the transfer determent time. Let dL2t be a time corresponding to the interval dL2. Let Lt1 be a distance between a primary transfer roller located most downstream among a plurality of primary transfer rollers that works (the primary transfer roller 13M in this case) and the primary transfer roller 13Y located downstream from the primary transfer rollers 13BK, 13M, and 13C in the rotation direction of the transfer belt 5. Let Lt1t be a time corresponding to the distance Lt1. Let Lt2 be a distance from the primary transfer roller 13Y to the secondary transfer roller 16 in the rotation direction of the transfer belt 5. Let Lt2t be a time corresponding to the distance Lt2. In FIG. 21B, "IMAGE WRITING BK" means an image writing timing by the LED head 10BK. Similarly, "IMAGE WRITING M", "IMAGE WRITING C", and "IMAGE WRITING Y" means an image writing timing by the LED heads 10M, 10C, and 10Y, respectively. Other elements illustrated in FIG. 21B are the same as those in FIG. 19B. For example, "SHEET PASSING THROUGH SECONDARY TRANSFER NIP" in FIG. 21B means a timing in which the sheet 157 passes through the secondary transfer nip. Let n be a number of toner images formed continuously (n=4 in FIG. 21A). The CPU 38 determines the interval dL1 between the toner images to meet a relationship $[(n\times Li)+((n-1)\times dL1)]\leq(Lt1+Lt2)$. Furthermore, the interval dL2 between the toner images after the toner image enters the secondary transfer nip satisfies a relationship of $dL2\geq(Lt1+Lt2)$. The CPU 38 determines an interval of the exposure timing based on the above conditions, a transportation speed of the intermediate transfer belt 5 and a rotational speed of the photoconductor drum 8Y.

Figure 22A:
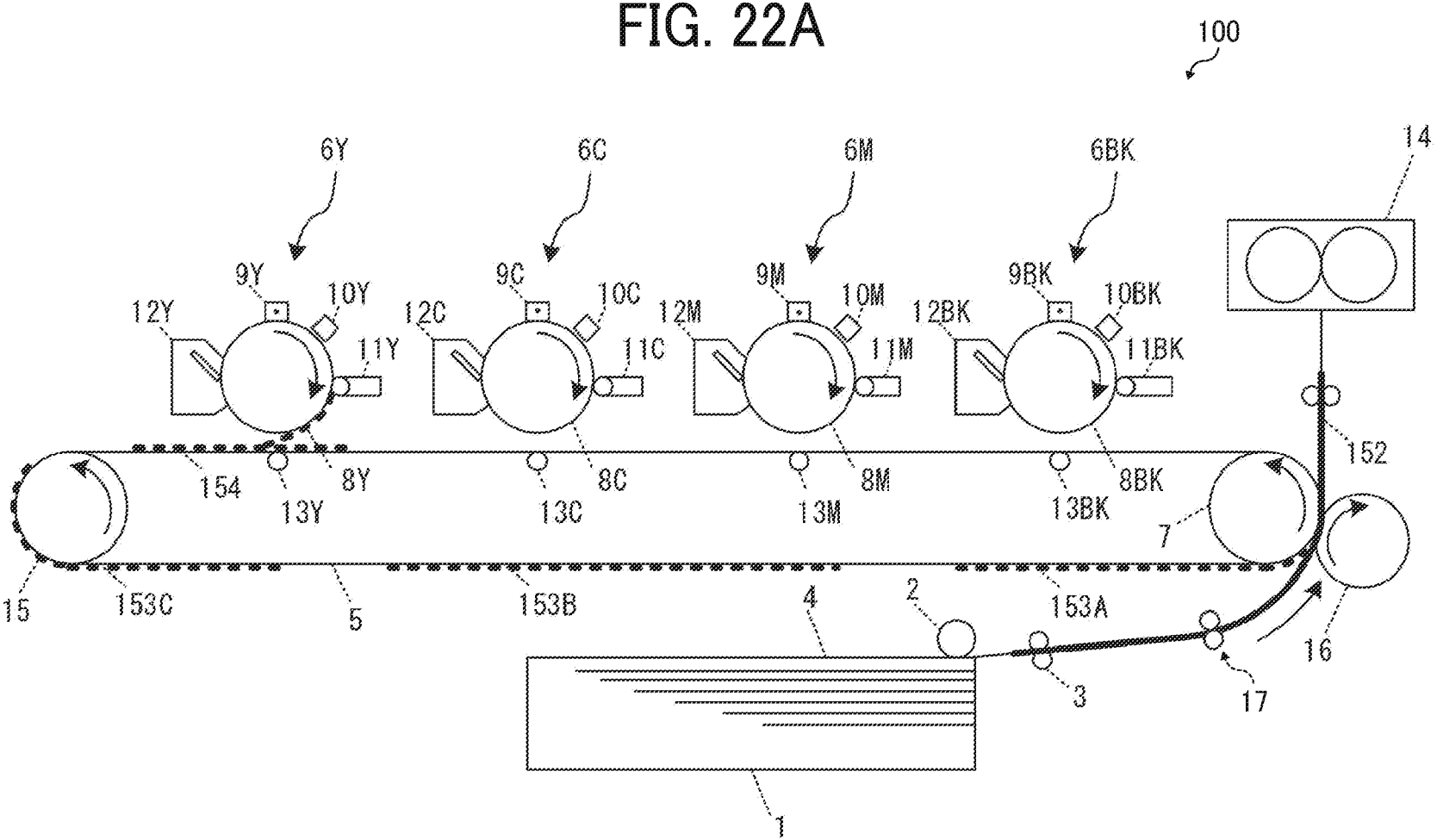
FIG. 22A is an explanatory diagram of a fourth method of the second embodiment of the image forming apparatus to avoid the impact at the secondary transfer nip.
Figure 22B:
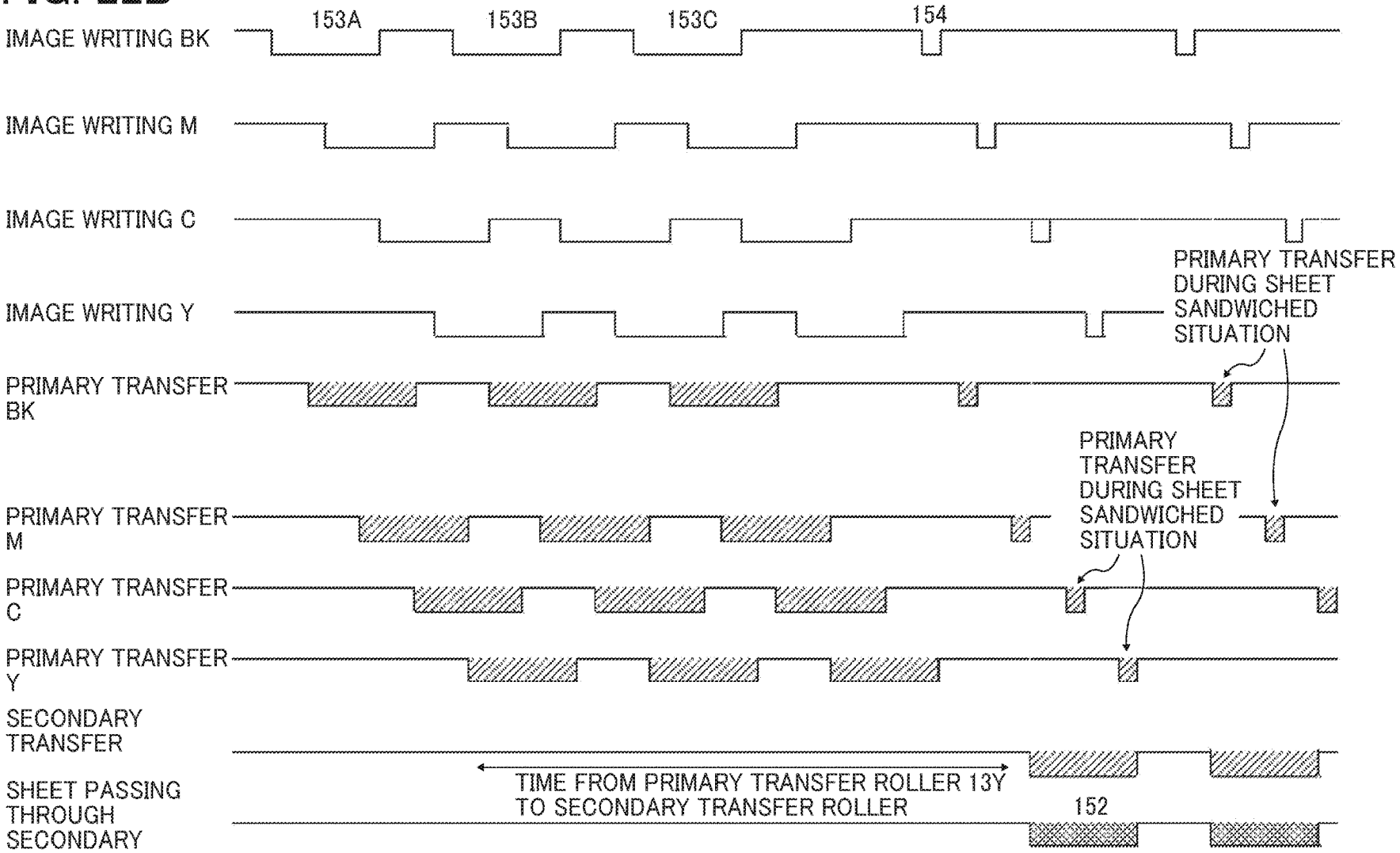
FIG. 22B is a timing chart of the fourth method of the second embodiment of the image forming apparatus to avoid the impact at the secondary transfer nip.
Figure 22C:
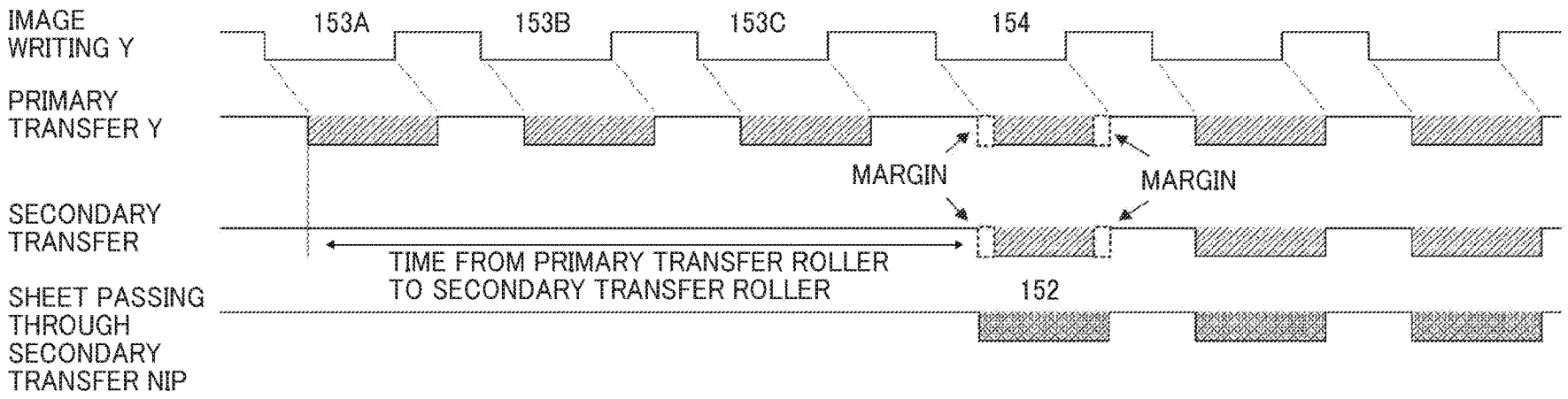
FIG. 22C is a timing chart of a revised method of the fourth method of the second embodiment of the image forming apparatus to avoid the impact at the secondary transfer nip.

FIGS. 22A, 22B, and 22C illustrate explanatory diagrams of a fourth method to avoid the impact at the secondary transfer nip. While the sheet 4 is sandwiched between the drive roller 7 and the secondary transfer roller 16, that is, from the time when the sheet 4 enters the secondary transfer nip to the time when the sheet 4 exits therefrom, the impact does not affect the toner image. Transferring the toner image to the intermediate transfer belt 5 in the above timing can avoid the affection of the impact from the secondary transfer nip. FIG. 22A illustrates the primary transfer of the toner image while the sheet 4 passes through the secondary transfer nip, that is, while the sheet 4 is sandwiched between the transfer belt 5 and the secondary transfer roller 16. After toner images 153A, 153B, and 153C are formed continuously, the first toner image 153A is transferred onto a sheet 152. If a toner image 154 subsequent to the toner image 153C is shorter than the sheet 152, the toner image 154 is transferred onto the intermediate transfer belt 5 while the sheet 152 enters the secondary transfer nip and exits therefrom. Unlike the second method described with reference to FIGS. 20A and 20B, productivity is improved because there is no need to wait the end of secondary transfer of the toner image 153C onto the sheet 4.

FIG. 22B is a timing chart illustrating the example illustrated in FIG. 22A. "PRIMARY TRANSFER BK" in FIG. 22B means a timing of the primary transfer of the black toner image at the primary transfer nip of the primary transfer roller 13BK. Similarly, "PRIMARY TRANSFER M", "PRIMARY TRANSFER C", and "PRIMARY TRANSFER Y" means a timing of the primary transfer of the magenta, cyan, and yellow toner images at the primary transfer nips of the primary transfer rollers 13M, 13C, and 13Y, respectively. Other elements illustrated in FIG. 22B are the same as those in FIG. 21B. For example, "SHEET PASSING THROUGH SECONDARY TRANSFER NIP" in FIG. 22B means a timing at which the sheet 152 passes through the secondary transfer nip. A premise of the above example is that a length of the toner image 154 in the transportation direction is shorter than a length of the sheet 152. However, the image forming apparatus 100 that sets a non-image space, that is, a margin, in a leading end and a trailing end of the sheet 4 in monochrome printing may primarily transfer a single toner image onto the intermediate transfer belt 5 while the previous sheet 152 enters the secondary transfer nip and exits therefrom as illustrated in FIG. 22C. As illustrated in FIG. 22C, while the sheet 152, which has margins in the leading end and the trailing end of the sheet 152, respectively, passes through the secondary transfer nip, the toner image 154 passes through the primary transfer nip. However, when there are the margins in the leading end and the trailing end of the toner image 154, the impact from the secondary transfer nip does not affect the image quality because regions that are affected by the impact from the secondary transfer nip are the margins, that is, the non-image spaces, in the leading end and the trailing end of the toner image 154.

Figure 23A:
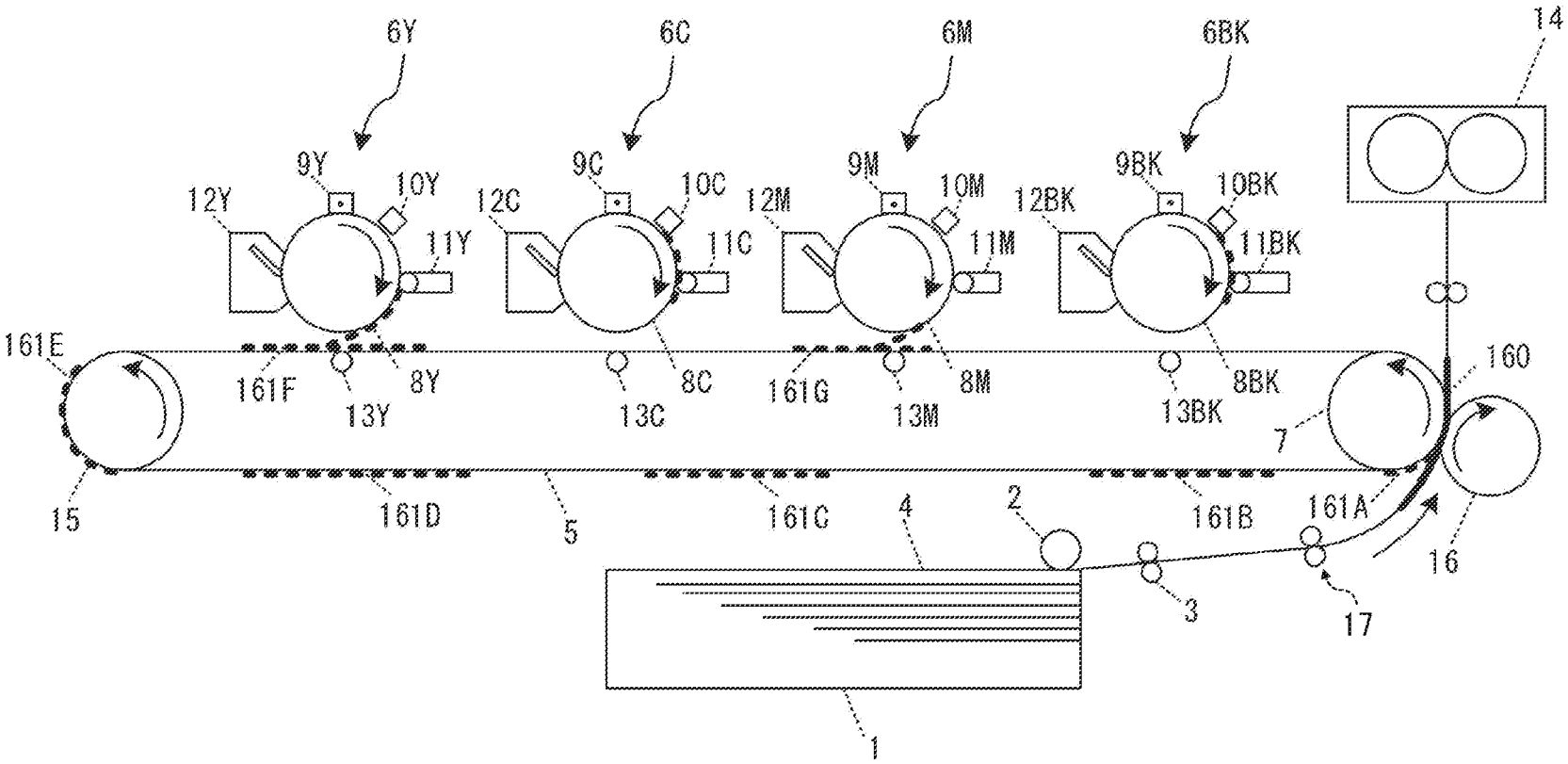
FIG. 23A is an explanatory diagram of a fifth method of the second embodiment of the image forming apparatus to avoid the impact at the secondary transfer nip.
Figure 23B:
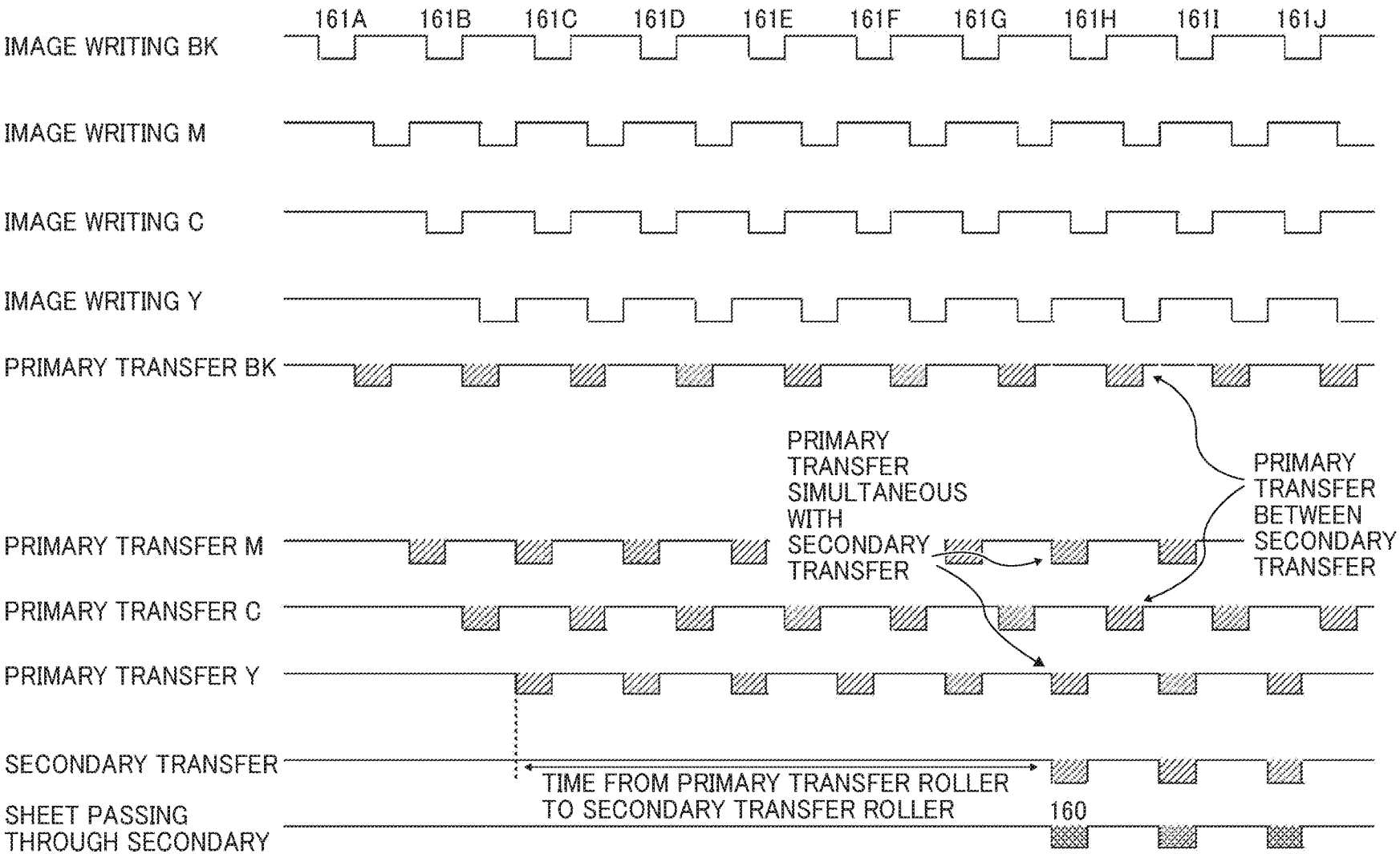
FIG. 23B is a timing chart of the fifth method of the second embodiment of the image forming apparatus to avoid the impact at the secondary transfer nip.

FIGS. 23A and 23B illustrate explanatory diagrams of a fifth method to avoid the impact at the secondary transfer nip. In this example, a length of a toner image on the intermediate transfer belt 5 in the transportation direction is shorter than a distance between neighboring primary transfer rollers (e.g., a distance between the primary transfer rollers 13BK and 13M, a distance between the primary transfer rollers 13M and 13C, and a distance between the primary transfer rollers 13C and 13Y). For example, if the image forming apparatus 100 is big, the image forming apparatus 100 has such configuration. With reference to FIG. 23A, a description is given of a control method of an interval between toner images in this case.

When a length of a toner image in one page, that is, the length of the toner image formed on one side of one recording medium, is shorter than the length between the neighboring primary transfer rollers, there is not a situation of the image forming devices 6Y and 6C illustrated in FIG. 17. That is, toner images to be transferred onto one arbitrary page are not primarily transferred from the plurality of photoconductor drums 8BK, 8M, 8C, and 8Y at the same time. As illustrated in FIG. 23A, toner images 161A to 161G may be formed on the intermediate transfer belt 5. In this case, as illustrated in a timing chart of FIG. 23B, a timing that a sheet 160 passes through the secondary transfer nip synchronizes with a timing that a subsequent toner image passes through the primary transfer nip. Especially, as illustrated in FIG. 22C, when the margin is formed at each of the leading end and the trailing end of the sheet 160, there is no need to consider the impact about the margins. Therefore, as illustrated in the timing chart of FIG. 23B, the timing that the sheet 160 passes through the secondary transfer nip synchronizes with the timing that the subsequent toner image passes through the primary transfer nip. Image data of the subsequent toner image includes data of the margins. That is, the image data of the subsequent toner image includes data of a content image and data of the margins that surround the content image.

It is possible to make a toner image of the primary transfer in the interval between sheets 4. In this case, toner images are formed continuously with a predetermined interval between the toner images. In FIG. 23B, image writing for toner images 161H, 161I, and 161J is executed after image writing for toner images 161A to 161G.

The fifth method in FIGS. 23A and 23B combines the method that the sheet passing timing through the secondary transfer nip synchronizes with the toner image passing timing through the primary transfer nip with the method that the toner image is transferred at the primary transfer nip from a time when a previous sheet exits the secondary transfer nip to a time when a following sheet enters the secondary transfer nip. Alternatively, one of the both methods may be used. As illustrated in FIG. 23B, the interval between the toner images is controlled to primarily transfer different toner images onto the intermediate transfer belt 5 simultaneously at the primary transfer rollers 13BK and 13C and to primarily transfer different toner images onto the transfer belt 5 simultaneously at the primary transfer rollers 13M and 13Y. Alternatively, the interval between the toner images may be controlled to primarily transfer different toner images onto the intermediate transfer belt 5 simultaneously at the primary transfer nips of the primary transfer rollers 13BK, 13M, 13C, and 13Y, respectively.

Figure 24:
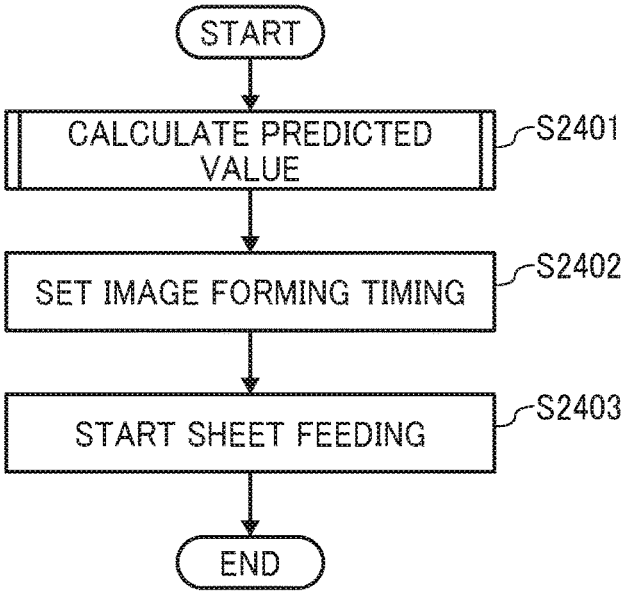
FIG. 24 is a flowchart illustrating an example of an entire operation of the image forming apparatus according to the second embodiment.

FIG. 24 is a flowchart illustrating the series of operations in the second embodiment. The CPU 38 calculates a predicted value of the image forming timing to avoid the impact that is made when the sheet 4 enters the secondary transfer nip and exits therefrom (step S2401). A calculation method of the predicted value in step S2401 is described later. The calculated value in step S2401 is a start timing of image forming or a time interval between image forming. However, the calculated value in step S2401 may be a distance data or a distance interval. The CPU 38 sets the image forming timing based on the predicted value calculated in step S2401 (step S2402). In this embodiment, the CPU 38 sets the timing of exposure by the LED head 10. Subsequently, the CPU 38 controls rollers to feed the sheet 4 at suitable timing (step S2403).

The flowchart in FIG. 24 illustrates a control to avoid the impact from the secondary transfer nip. The control illustrated in FIG. 24 does not include the slip amount prediction described in the first embodiment. For example, the CPU 38 may execute the first embodiment and the second embodiment by binding steps S2, S3, S4, and S5 in FIG. 4 and the steps in FIG. 24.

Figure 25:
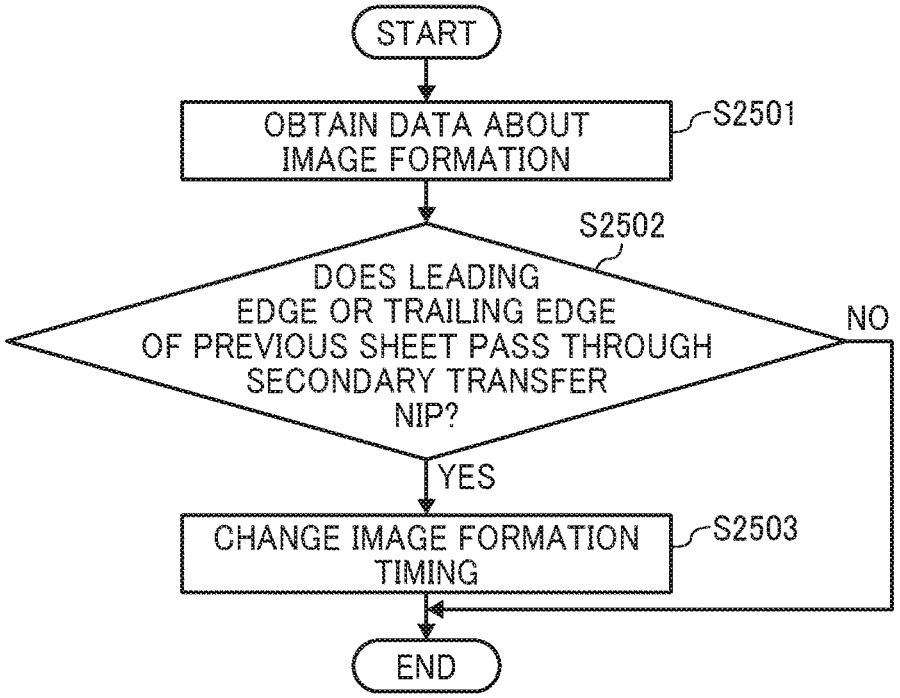
FIG. 25 is a flowchart illustrating a calculation process of a predicted value in the second embodiment of the image forming apparatus.

FIG. 25 is a flowchart illustrating a calculation flow example of step S2401 (a calculation of the predicted value) in FIG. 24. The CPU 38 obtains data about image formation of the image forming apparatus 100 (step S2501).

The CPU 38 determines whether a leading end or a trailing end of a previous sheet 4 passes through the secondary transfer nip while a leading end to a trailing end of a toner image to be transferred onto a following sheet 4 passes the primary transfer nip (step S2502).

If the CPU 38 determines positively in step S2502 (YES in step S2502), the CPU 38 changes image formation timing to avoid transferring the toner image to the intermediate transfer belt 5 when the previous sheet 4 enters the secondary transfer nip or exits therefrom because the unchanged image formation timing causes the image deterioration by the impact (step S2503). The CPU 38 calculates a start timing of the exposure by the LED head 10 as the predicted value not to transfer the toner image onto the intermediate transfer belt 5 both at the timing when the sheet 4 enters the secondary transfer nip and at the timing when the sheet 4 exits therefrom. Thus, the CPU 38 delays the image formation timing. If the CPU 38 determines negatively in step S2502 (NO in step S2502), the CPU 38 does not change the image formation timing and proceeds to an original image formation timing.

Figure 26:
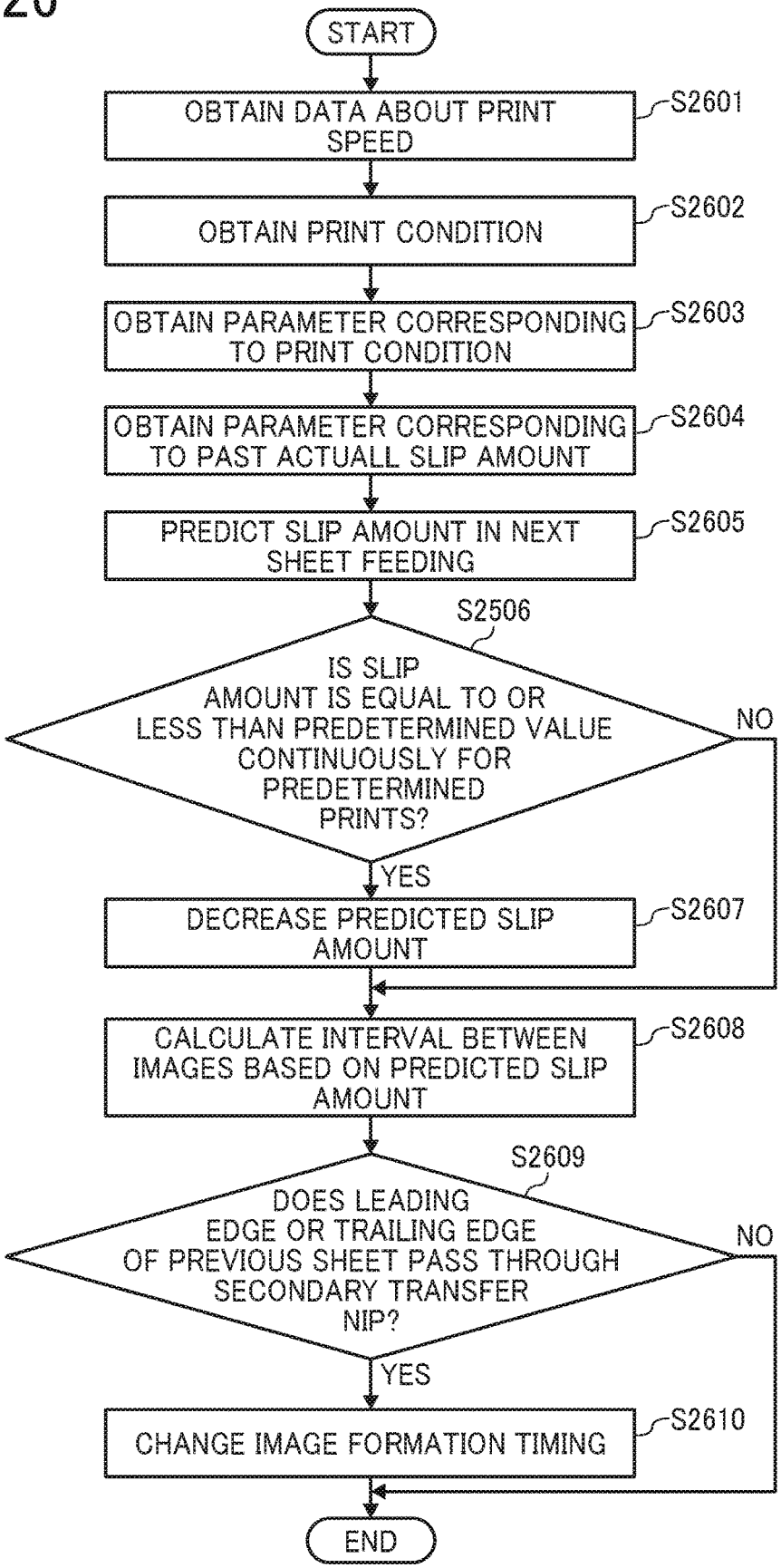
FIG. 26 is a flowchart illustrating a calculation process of a predicted value in the second embodiment including the first embodiment of the image forming apparatus.

FIG. 26 is a flowchart illustrating a calculation example of the predicted value, which binding the first embodiment and the second embodiment to avoid deterioration of the image quality due to the impact. The action of the second embodiment may be included in steps S2 S3, S4, and S5 of FIG. 4. As illustrated in FIG. 26, steps S2601 to S2608 are the same as steps S701 to S708 in FIG. 9A. In addition, steps S2609 and S2610 are the same as steps S2502 and S2503 in FIG. 25.

Hence, it is possible to bind the first embodiment and the second embodiment easily. Only the second embodiment may be realized. Key steps of the second embodiment, steps S2502 and S2503 in FIG. 25 may be inserted to the flowchart of the first embodiment, that is, between step S406 and step S407 in FIG. 8, step S606 and S607 in FIG. 9, step S507 and the step S508 in FIG. 12, and steps S1507 and S1508 in FIG. 15. Steps S2502 and S2503 of the second embodiment in FIG. 25 may be involved. Similarly, the second embodiment may be applied to the flowchart in FIG. 16.

In the above case, the CPU 38 controls the exposure not to transfer the toner image onto the intermediate transfer belt 5 both at the timing when the sheet 4 enters the secondary transfer nip and the timing when the sheet 4 exits therefrom. Instead, the CPU 38 may control the exposure not to transfer the toner image onto the intermediate transfer belt 5 at either the timing when the sheet 4 enters the secondary transfer nip or the timing when the sheet 4 exits therefrom.

The second embodiment makes it possible to avoid the impact that happens when the sheet 4 enters the secondary transfer nip and exits therefrom and suppress the deterioration of the image quality due to the impact.

Thus, the image forming apparatus 100 in each of the embodiments prevents deterioration of the image quality.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, and in an order different from the one described above.

What is claimed is:

1. An image forming apparatus comprising:
- an image bearer;
- an image forming device to form an image on the image bearer;
- a transfer device to transfer the image formed on the image bearer onto a sheet;
- a plurality of sheet trays to store sheets;
- a sheet feeder to convey the sheet from a sheet tray among the plurality of sheet trays to the transfer device;
- a temperature sensor to detect a temperature of the image forming apparatus; and
- a slip amount prediction controller configured to:
  - calculate a predicted slip amount between the sheet feeder and the sheet before forming the image based on the temperature of the image forming apparatus, a thickness of the sheet, and the sheet tray among the plurality of sheet trays selected to convey the sheet;
  - calculate an interval between the images formed on the image bearer based on the predicted slip amount; and
  - control the image forming device based on the calculated interval between the images to form the image on the image bearer.

2. The image forming apparatus according to claim 1, further comprising:
- a detector located in a path of the sheet between the plurality of sheet trays and the transfer device to detect a conveyance of the sheet; and
- a memory to store a start time of feeding the sheet from the sheet tray and a detected time in which the detector detects the sheet,
- wherein the slip amount prediction controller is configured to:
  - calculate a time difference between the start time of feeding and the detected time;
  - calculate an actual slip amount between the sheet and the sheet feeder based on a distance between the sheet tray and the detector and the calculated time difference between the start time of feeding and the detected time; and
  - store the calculated actual slip amount in the memory.

3. The image forming apparatus according to claim 2, wherein the slip amount prediction controller is configured to:
- determine whether the detector detects the sheet fed from the sheet tray within a predetermined time;
- calculate the actual slip amount when the slip amount prediction controller determines the detector detects the sheet within the predetermined time; and
- execute jam processing when the slip amount prediction controller determines the detector does not detect the sheet within the predetermined time.

4. The image forming apparatus according to claim 2, further comprising:
- a situation detector to detect a change in condition of the sheet in the sheet tray,
- wherein the slip amount prediction controller is configured to:
  - determine whether the situation detector detects a possibility of the change in condition of the sheet in the sheet tray;
  - initialize the predicted slip amount stored in the memory when the situation detector detects the change in condition of the sheet in the sheet tray; and
  - calculate the predicted slip amount.

5. The image forming apparatus according to claim 1, further comprising a productivity information obtaining device to obtain a print speed of image forming by the image forming apparatus, wherein the slip amount prediction controller calculates the predicted slip amount to set a limit value that does not decrease the print speed of the image forming obtained by the productivity information obtaining device.

6. The image forming apparatus according to claim 1, further comprising a print condition obtaining device to obtain a print condition of image forming by the image forming apparatus, wherein the slip amount prediction controller calculates the predicted slip amount based on the print condition obtained by the print condition obtaining device.

7. The image forming apparatus according to claim 1, wherein the slip amount prediction controller changes the calculated predicted slip amount to widen the calculated interval between the images for a next print after a sheet jam occurs in the sheet feeder.

8. The image forming apparatus according to claim 7, wherein the slip amount prediction controller changes the predicted slip amount to narrow the widened interval between the images if the predicted slip amount is less than or equal to a predetermined value for a predetermined number of prints after the sheet jam.

9. The image forming apparatus according to claim 1, wherein the sheet feeder includes:

a feed roller to feed the sheet from the sheet tray; and a registration roller, and wherein the slip amount prediction controller controls a change of a timing to form the image on the image bearer for a following sheet when a time from a start timing of the feed roller feeding the following sheet to a timing of which a previous sheet to be stopped by the registration roller is shorter than a time from the start timing to a timing of which the following sheet starts moving.

10. The image forming apparatus according to claim 9, wherein the slip amount prediction controller changes the timing to form the image such that a feeding timing of the following sheet is a release timing of the previous sheet stopped by the registration roller when the slip amount prediction controller changes the timing for forming the image.

11. The image forming apparatus according to claim 1, wherein the transfer device includes a roller and transfers the image formed on the image bearer to the sheet sandwiched at a nip formed by the roller and the image bearer, and wherein the slip amount prediction controller controls forming the image on the image bearer by the image forming device to avoid forming the image on the image bearer at least at one of a timing when the sheet enters the nip and a timing when the sheet exits the nip.

12. The image forming apparatus according to claim 11, wherein the slip amount prediction controller controls such that the image to be transferred onto one side of the sheet is formed on the image bearer before transferring the image to the sheet.

13. The image forming apparatus according to claim 11, wherein the slip amount prediction controller controls to form the image on the image bearer continuously as long as the image fits inside a region between the image forming device and the nip, and to stop forming the image on the image bearer until the formed image is transferred onto the sheet.

14. The image forming apparatus according to claim 11, wherein the slip amount prediction controller controls to allow forming the image on the image bearer while the sheet is sandwiched at the nip when the image formed on the image bearer includes a non-image space.

15. An image forming method comprising:

providing an image forming apparatus comprising: an image bearer; an image forming device to form an image on the image bearer; a transfer device to transfer the image formed on the image bearer onto a sheet; a plurality of sheet trays to store sheets; a sheet feeder to convey the sheet from a sheet tray among the plurality of sheet trays to the transfer device; and a temperature sensor to detect a temperature of the image forming apparatus;

detecting the temperature of the image forming apparatus;

calculating a predicted slip amount between the sheet feeder and the sheet before forming the image based on the temperature of the image forming apparatus, a thickness of the sheet, and the sheet tray among the plurality of sheet trays selected to convey the sheet;

calculating an interval between images formed on the image bearer based on the calculated predicted slip amount; and controlling the image forming device based on the calculated interval between the images to form the image on the image bearer.

* * * * *